US008009130B2

(12) United States Patent
Kim et al.

(10) Patent No.: US 8,009,130 B2
(45) Date of Patent: Aug. 30, 2011

(54) LIQUID CRYSTAL DISPLAY DEVICE AND METHOD OF DRIVING THE SAME

(75) Inventors: Binn Kim, Seoul (KR); Hyung Nyuck Cho, Incheon-si (KR); Ju Pyoung Kim, Gumi-si (KR); Min Doo Chun, Seoul (KR); Oh Jong Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 892 days.

(21) Appl. No.: 11/982,992

(22) Filed: Nov. 6, 2007

(65) Prior Publication Data

US 2008/0106535 A1 May 8, 2008

(30) Foreign Application Priority Data

Nov. 6, 2006 (KR) ..... 10-2006-0108844
Feb. 27, 2007 (KR) ..... 10-2007-0019574

(51) Int. Cl.
*G09G 3/36* (2006.01)

(52) U.S. Cl. ..... 345/87; 345/210; 345/212; 345/213; 345/691

(58) Field of Classification Search ..... 345/87–100, 345/204–215, 690–691
See application file for complete search history.

(56) References Cited

U.S. PATENT DOCUMENTS 6,556,181 B2 * 4/2003 Yamada et al. ..... 345/88
6,831,621 B2 * 12/2004 Nakano ..... 345/87
2002/0113764 A1 * 8/2002 Yamada et al. ..... 345/88
2003/0020677 A1 * 1/2003 Nakano ..... 345/87
2005/0083321 A1 4/2005 Boer

FOREIGN PATENT DOCUMENTS

CN 1338719 A 3/2002
CN 1530906 A 9/2004
CN 1551079 A 12/2004
JP 01-303881 12/1989
JP 02-296286 12/1990

(Continued)

OTHER PUBLICATIONS

Office Action issued in corresponding Chinese Patent Application 2007101658507; dated Mar. 6, 2009.

(Continued)

*Primary Examiner* — Vijay Shankar
(74) *Attorney, Agent, or Firm* — Brinks Hofer Gilson & Lione

(57) ABSTRACT

A liquid crystal display device and a method of driving the same is disclosed, which can decrease the number of source drive integrated circuits ICs used to supply data, and can also decrease a flexible printed circuit and a printed circuit board to supply signals to the source drive integrated circuits ICs in size. The liquid crystal display device comprises a liquid crystal panel including a plurality of data lines formed along a long-axis direction of substrate, and a plurality of gate lines formed along a short-axis direction of substrate, wherein each gate line is orthogonal to each data line; a data driving circuit to supply data voltages to the data lines; a gate driving circuit to supply scan pulses to the gate lines; and a timing controller to supply digital video data to the data driving circuit, and to control the data driving circuit and the gate driving circuit.

12 Claims, 25 Drawing Sheets

FOREIGN PATENT DOCUMENTS

| | | |
|---|---|---|
| JP | 2001-175199 | 6/2001 |
| JP | 2001-194645 | 7/2001 |
| JP | 2002-023135 | 1/2002 |
| JP | 2003-195829 | 7/2003 |
| JP | 2004-093887 | 3/2004 |

OTHER PUBLICATIONS

Office Action issued in corresponding Japanese Patent Application No. 2007-288125, mailed Feb. 2, 2011.

* cited by examiner

LIQUID CRYSTAL DISPLAY DEVICE AND METHOD OF DRIVING THE SAME

CLAIM FOR PRIORITY

This application claims the benefit of Korean Patent Application both Nos. P06-108844 filed on Nov. 6, 2007 and P2007-19574, filed on Feb. 27, 2007, which is hereby incorporated by reference as if fully set forth herein.

BACKGROUND

1. Field of the Invention

The present invention relates to a liquid crystal display device which can decrease the number of source drive integrated circuits ICs used to supply data, and also can decrease a flexible printed circuit and a printed circuit board to supply signals to the source drive integrated circuits ICs in size, and a method of driving the same.

2. Description of the Related Art

A liquid crystal display device displays picture images by controlling light transmittance of liquid crystal cells according to video signals. Particularly, an active matrix type liquid crystal display device is suitable for displaying moving pictures since it is provided with switching devices formed in the liquid crystal cells, respectively. In this case, the switching devices are generally formed of thin film transistors (hereinafter, referred to as "TFT").

FIG. 1 is a schematic diagram of illustrating an active matrix type liquid crystal display device according to the related art. FIG. 2 is an equivalent circuit diagram illustrating a thin film transistor TFT array substrate with a 4×4 matrix type of 'liquid crystal cells in a liquid crystal panel of the type shown in FIG. 1. FIG. 3 is a waveform diagram illustrating signals supplied to signal lines of a matrix type of liquid crystal cells shown in FIG. 2.

Referring to FIGS. 1 to 3, an active matrix type liquid crystal display device includes a liquid crystal panel 14 provided with a plurality of gate lines G1 to Gn, a plurality of data lines D1 to Dm, and a plurality of thin film transistors TFTs for driving liquid crystal cells Clc Each gate line is orthogonal to each data line, and each thin film transistor is formed adjacent to a crossing portion of the gate and data lines. A data driving circuit 12 is provided to drive the data lines D1 to Dm of the liquid crystal panel 14. A gate driving circuit 13 is provided to drive the gate lines G1 to Gn of the liquid crystal panel 14. A timing controller 11 is provided to control the data driving circuit 12 and the gate driving circuit 13.

The data driving circuit 12 is provided with a plurality of source drive integrated circuits ICs. Under the control of a timing controller 11, the data driving circuit 12 converts digital data to analog data voltages R1 to R4, G6 to G4 and B1 to B4 by using an analog gamma compensation voltage, and supplies the analog data voltages to the data lines D1 to Dm. Also, the gate driving circuit 13 includes a plurality of gate drive integrated circuits ICs. Under the control of the timing controller 11, the gate driving circuit 13 supplies scan pulses SP1 to SP4 to the gate lines G1 to Gn in sequence.

The respective scan pulses SP1 to SP4 are generated in about one horizontal period. Also, the data voltages R1 to R4, G1 to G4 and B1 to B4 are supplied to the data lines D1 to Dm in synchronization with the scan pulses SP1 to SP4. Then, the thin film transistors TFTs are turned-on in response to the scan pulses SP1 to SP4, whereby the data voltages output from the data lines D1 to Dm are supplied to pixel electrode PIX of the liquid crystal cells Clc. The liquid crystal cells Clc are arranged between the pixel electrode PIX supplied with the data voltage and a common electrode supplied with a common voltage Vcom. In this case, liquid crystal molecules are aligned based on an electric field generated by the pixel electrode PIX and the common electrode COM, to thereby modulate polarizing elements of incident light.

The timing controller 11 generates a gate control signal GDC to control the gate driving circuit 13 and a data control signal DDC to control the data driving circuit 12 by using horizontally and vertically synchronized signals H and V and clocks CLK. In this case, the data control signal DDC includes a source start pulse SSP, a source shift clock SSC, a source output enable signal SOE, and a polarity control signal POL. Also, the gate control signal GDC includes a gate shift clock GSC, a gate output enable GOE, and a gate start pulse GSP.

In FIG. 1, 'Cst' connected to the liquid crystal cell Clc corresponds to a storage capacitor to maintain the voltage of liquid crystal cell Clc. The storage capacitor Cst may be formed in Storage-On-Gate method or Storage-On-Common method. In case of the Storage-On-Gate method, the storage capacitor Cst is connected between the preceding gate line and the pixel electrode PIX. In case of the Storage-On-Common method, the storage capacitor Cst is connected between the additional common electrode COM and the pixel electrode PIX. Also, the source drive integrated circuits ICs and gate drive integrated circuits ICs are bonded on a substrate by a Tape Automated Bonding (hereinafter, referred to as "TAB") method shown in FIG. 4, or by a Chip On Glass (hereinafter, referred to as "COG") method shown in FIG. 5.

In the TAB method of FIG. 4, the source drive integrated circuits ICs 51 and gate drive integrated circuits ICs 55 are respectively mounted on Tape Carrier Packages (hereinafter, referred to as "TCP") 52 and 56. In this case, output pads of the TCPs 52 and 56 are adhered to data pads or gate pads of a glass substrate by anisotropic conductor film ACF. Also, input pads of the source TCPs 52 are adhered to output pads of the source PCB 53 on which the timing controller 11 and gamma reference voltage generation circuits (not shown) are mounted. Also, input pads of the gate TCPs 56 are adhered to output pads of the gate PCB 57. Then, the source PCB 53 is connected to the gate PCB 57 by an FPC 54. Through the FPC 54, driving voltages and control signals required for the gate drive integrated circuits ICs are supplied to the gate PCB 57 from the source PCB 53. In the COG method, the source drive integrated circuits ICs 61 and gate drive integrated circuits ICs 65 are directly adhered to a glass substrate by using conductive bumps, as shown in FIG. 5. In FIG. 5, '62' corresponds to the FPC which is adhered to the glass substrate and supplies the voltage and signal required for the source drive integrated circuits ICs 61 and gate drive integrated circuits ICs 65 and generated from the source PCB 63.

In FIGS. 4 and 5, '50' and '60' correspond a pixel array where each of the data lines D1 to Dm is orthogonal to each of the gate lines G1 to Gn, and the liquid crystal cells Clc are arranged in the matrix configuration. In the liquid crystal display device, since the data lines D1 to Dm are arranged along the long-axis direction (X-axis) of liquid crystal panel 14, the number of data lines is larger than the number of gate lines. As a result, the number of the source drive integrated circuits ICs 51 and 61 for driving the data lines is increased. Also, since the unit cost of source drive integrated circuits ICs 51 and 61 is higher than the unit cost of gate drive integrated circuits ICs 55 and 65, it increases the cost of fabrication of the liquid crystal display device. Recently, in case of the liquid crystal panel 14 having XGA resolution (1024*768), if the source drive integrated circuits ICs 51 and 61 have 618 output channels, it necessarily requires five source drive integrated circuits ICs. Also, the fabrication cost of liquid crystal display device is further increased due to the relatively large size of PCBs and FPC.

Liquid crystal display devices have the disadvantage of low picture quality since the common voltage Vcom is changed. This problem of low picture quality is caused by the load generated with the crossing of the common electrode 71, 81 supplied with the common voltage Vcom and the data lines D1 to Dm supplied with the data voltages.

FIG. 6 is the example of illustrating the crossing of the data lines and the common electrode 71 in the Storage-On-Common method. FIG. 7 is the example of illustrating the crossing of the data lines and the common electrode 81 in an In-Plane Switching mode (hereinafter, referred to as "IPS") where the pixel electrode PIX and the common electrode COM are formed on the same substrate. As shown in FIGS. 6 and 7, if the data lines D1 to Dm are orthogonal to the common electrode 71, 81, an electric coupling occurs between the crossing of the data lines D1 to Dm and the common electrode 71, 81. Due to the electric coupling between the data lines D1 to Dm and the common electrode 71, 81, the common voltage Vcom becomes inconstant by the data lines supplied with the data voltage by the unit of one horizontal period.

SUMMARY

A liquid crystal display device comprises a liquid crystal panel including a plurality of data lines formed along a short-axis direction of substrate, and a plurality of gate lines formed along a long-axis direction of substrate. Each gate line is orthogonal to each data line. A data driving circuit supplies data voltages to the data lines. A gate driving circuit to supply scan pulses to the gate lines. A timing controller supplies digital video data to the data driving circuit, and controls the data driving circuit and the gate driving circuit.

In another aspect of the present disclosure, a liquid crystal display device comprises a liquid crystal panel including a plurality of odd and even numbered data lines formed along a short-axis direction of substrate, and a plurality of gate lines formed along a long-axis direction of substrate. Each gate line is orthogonal to each data line. A data driving circuit supplies data voltages to the data lines. A gate driving circuit supplies scan pulses to the gate lines. A timing controller supplies digital video data to the data driving circuit, and controls the data driving circuit and the gate driving circuit, wherein two sub-pixels with one gate line interposed therebetween use one gate line in common.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the disclosure and together with the description serve to explain the principle of the invention. In the drawings.

DETAILED DESCRIPTION OF THE DISCLOSURE

Reference will now be made in detail to the preferred embodiments of the present disclosure, examples of which are illustrated in the accompanying drawings. Wherever possible, the same reference numbers will be used throughout the drawings to refer to the same or like parts.

Hereinafter, a liquid crystal display device according to the preferred embodiment of the present disclosure and a method of driving the same will be explained with reference to FIGS. 8 to 25.

Figure 8:
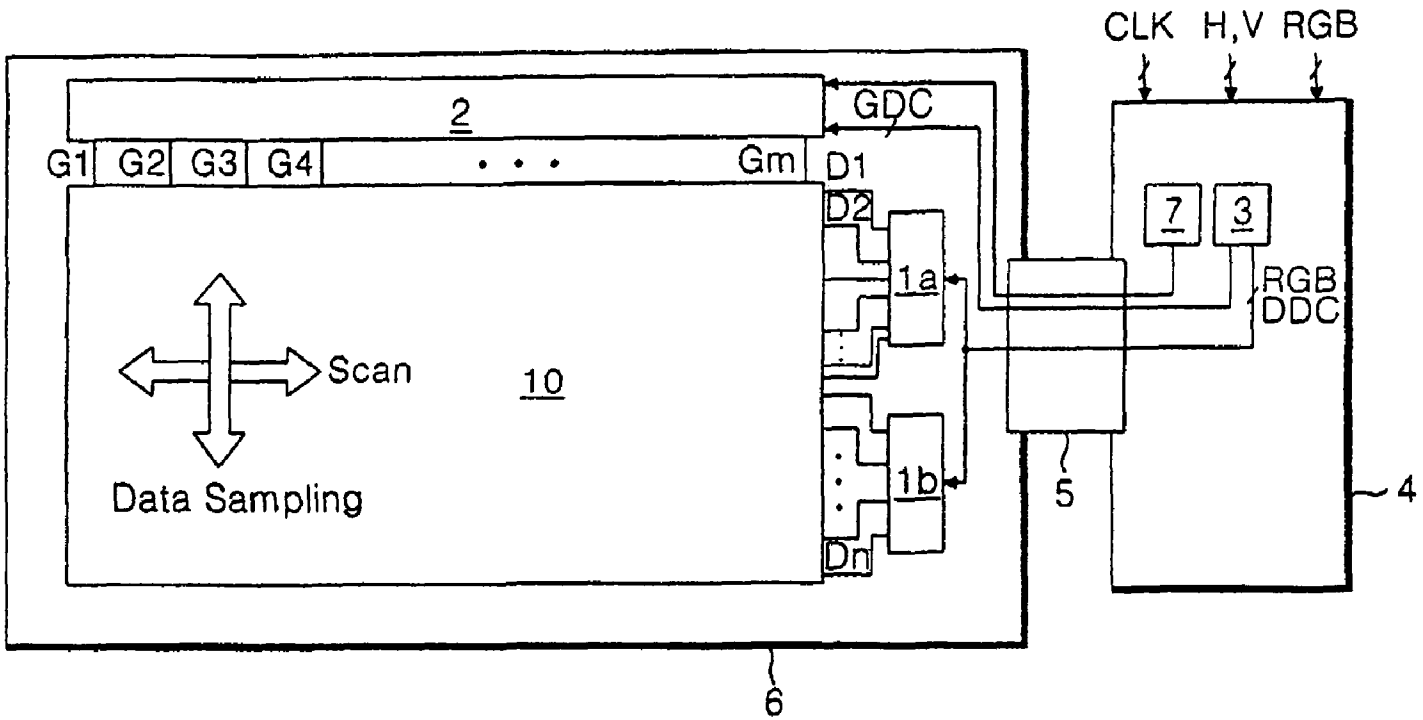
FIG. 8 is a block diagram of illustrating a liquid crystal display device according to the first embodiment of the present disclosure.

Referring to FIG. 8, the liquid crystal display device according to the preferred embodiment of the present disclosure includes 'm' gate lines G1 to Gm arranged along a long-axis direction (X-axis direction) of a pixel array 10 of a liquid crystal panel 6; 'n' data lines D1 to Dn arranged along a short-axis direction (Y-axis direction) of the pixel array 10 of the liquid crystal panel 6, wherein each of the data lines D1 to Dn is orthogonal to each of the gate lines G1 to Gm; a gate driving circuit 2 directly formed on a glass substrate of the liquid crystal panel 6; source drive integrated circuits ICs 1*a* and 1*b* included in a data driving circuit adhered to the glass substrate of the liquid crystal panel 6 by a COG or TCP type; and an FPC 5 connected between the liquid crystal panel 6 and a source PCB 4.

On the pixel array 10, there are 'm×n' liquid crystal cells formed in respective pixel regions defined by the crossing of the data lines D1 to Dn and the gate lines G1 to Gm. The liquid crystal panel 6 is comprised of two glass substrates facing each other, and a liquid crystal layer formed by injecting liquid crystal into a space formed between the two glass substrates facing each other.

Figure 9:
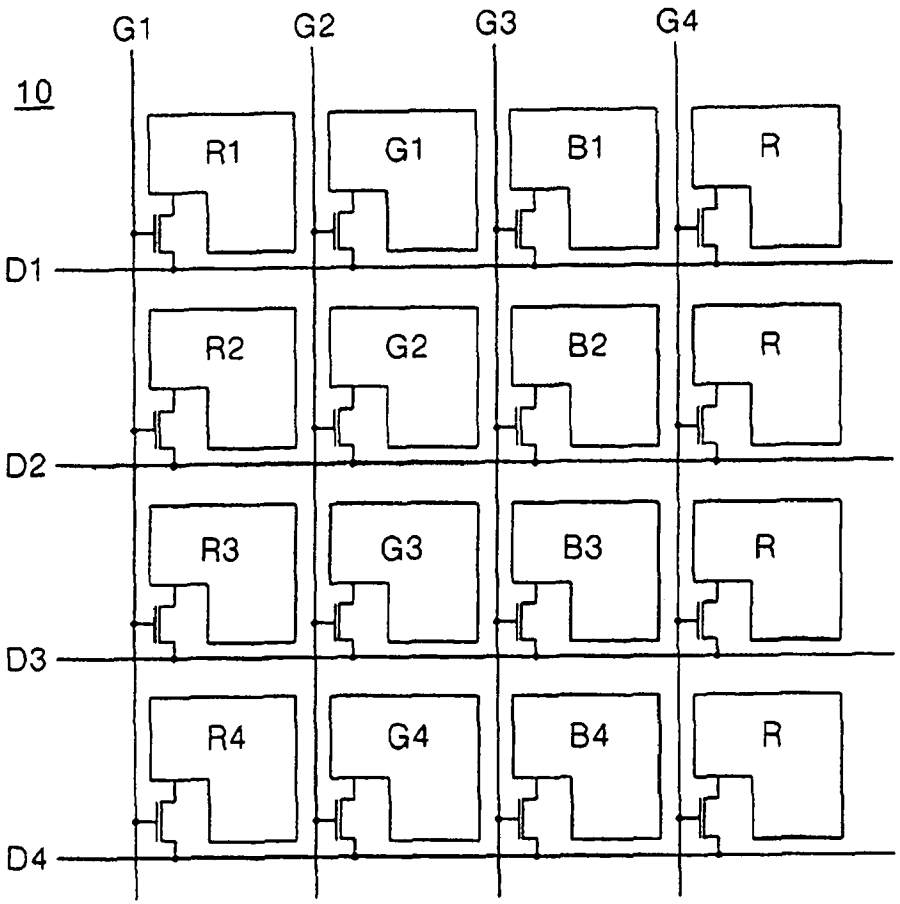
FIG. 9 is a diagram of illustrating the first embodiment of pixel array shown in FIG. 8.
Figure 13:
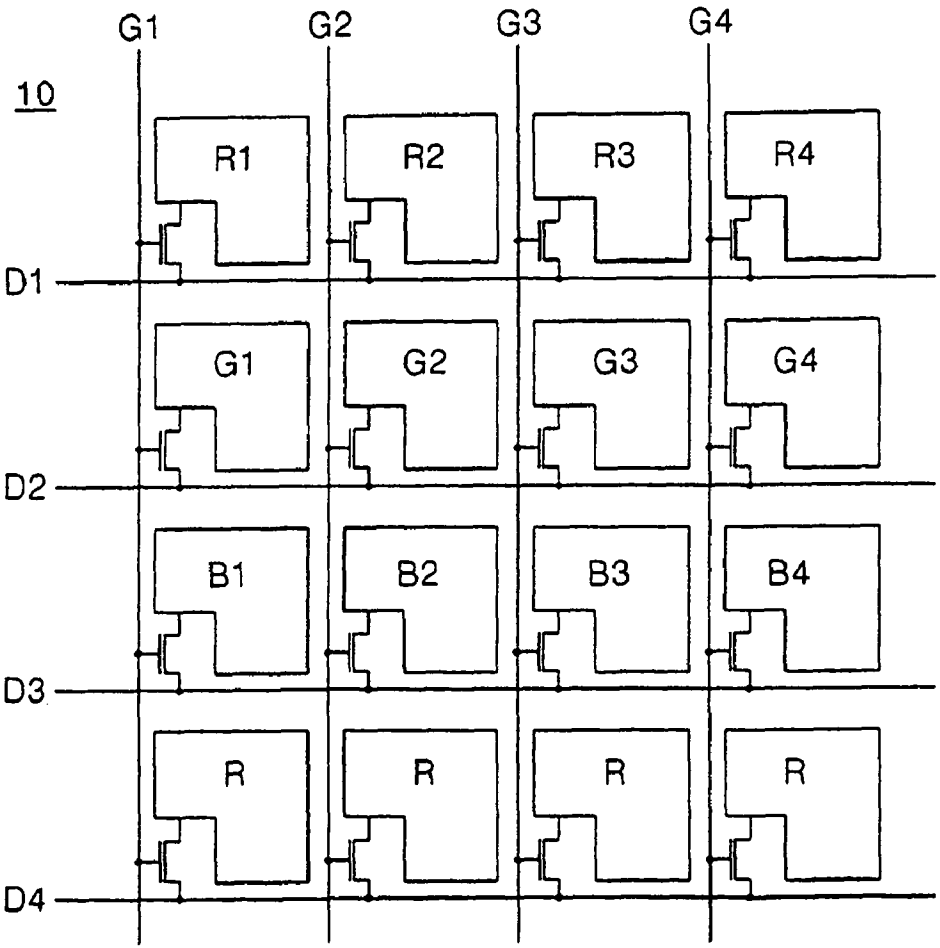
FIG. 13 is a diagram of illustrating the second embodiment of pixel array shown in FIG. 8.

One of the two glass substrates corresponds to a thin film transistor TFT array substrate on which the data lines D1 to Dn are orthogonal to the gate lines G1 to Gm. Also, thin film transistors TFT are formed adjacent to the crossings of the gate lines G1 to Gm and data lines D1 to Dn. In response to scan pulses from the gate lines G1 to Gm, the thin film transistors TFTs supply data from the data lines D1 to Dn to the liquid crystal cells. As shown in FIGS. 9 and 13, the thin film transistors TFTs include a gate electrode connected to the gate lines G1 to Gm, a source electrode connected to the data lines D1 to Dn, and a drain electrode connected to a pixel electrode of the liquid crystal cells Clc. Furthermore, the TFT array substrate includes a storage capacitor connected with the liquid crystal cells Clc. The storage capacitor may be formed in a Storage-On-Gate method or a Storage-On-Common method. In case of the Storage-On-Gate method, the storage capacitor is formed between the pixel electrode supplied with the data voltage and the preceding gate line to select a preceding vertical line by the preceding scan pulse. In case of the Storage-On-Common method, the storage capacitor is formed between a common electrode 8 supplied with a common voltage Vcom and the pixel electrode supplied with the data voltage.

The other of the two glass substrates corresponds to a color filter array substrate which is opposite to the TFT array substrate in state of interposing the liquid crystal cells therebetween. The color filter array substrate is comprised of a color filter and a black matrix. Each of the TFT array substrate and the color filter array substrate includes an alignment film to determine pretilt of liquid crystal molecules, and a polarizer to transmit specific linearly-polarized light. The common electrode being in opposite to the pixel electrode and supplied with the common voltage may be formed on the TFT array substrate or the color filter array substrate.

Instead of the adherence of gate driving circuit 2 to the glass substrate by COG or TAB, inner parts of the gate driving circuit 2 are formed simultaneously with the gate lines G1 to Gm, the data lines D1 to Dn, and the thin film transistors TFTs included in the pixel array on the process of fabricating the TFT array substrate. This mounting method of gate driving circuit 2 is referred to as a "Gate-In-Panel" method. The gate driving circuit 2 includes a shift register and an output buffer. Also, the gate driving circuit 2 sequentially supplies the scan pulse to the gate lines G1 to Gm in response to a control signal GDC output from a timing controller 3. Since the gate lines G1 to Gm are arranged along the long-axis direction of the liquid crystal panel 6, the gate driving circuit 2 sequentially supplies the scan pulse from the left side to the right side of the liquid crystal panel 6, or from the right side to the left side of the liquid crystal panel 6.

Referring to FIG. 9, if red, green and blue sub-pixels are arranged along the short-axis direction of the liquid crystal panel 6, a period between a point of generating the scan pulse supplied to the 'k+1'th gate line ('k' is an integer above 0) and a point of generating the scan pulse supplied to the 'k+4'th gate line satisfies about one horizontal period (1H). For the realization of a pre-charging effect of data to obtain a charging time of liquid crystal cell, the scan pulses generated in one horizontal period (1H) may be overlapped or not overlapped. At this time, the size of one horizontal period (1H) is virtually identical to a period of supplying the data voltage to one horizontal line in a related art liquid crystal display device having the same resolution. The following one horizontal period (1H) corresponds to the period of supplying the data voltage to one horizontal line.

Figure 18:
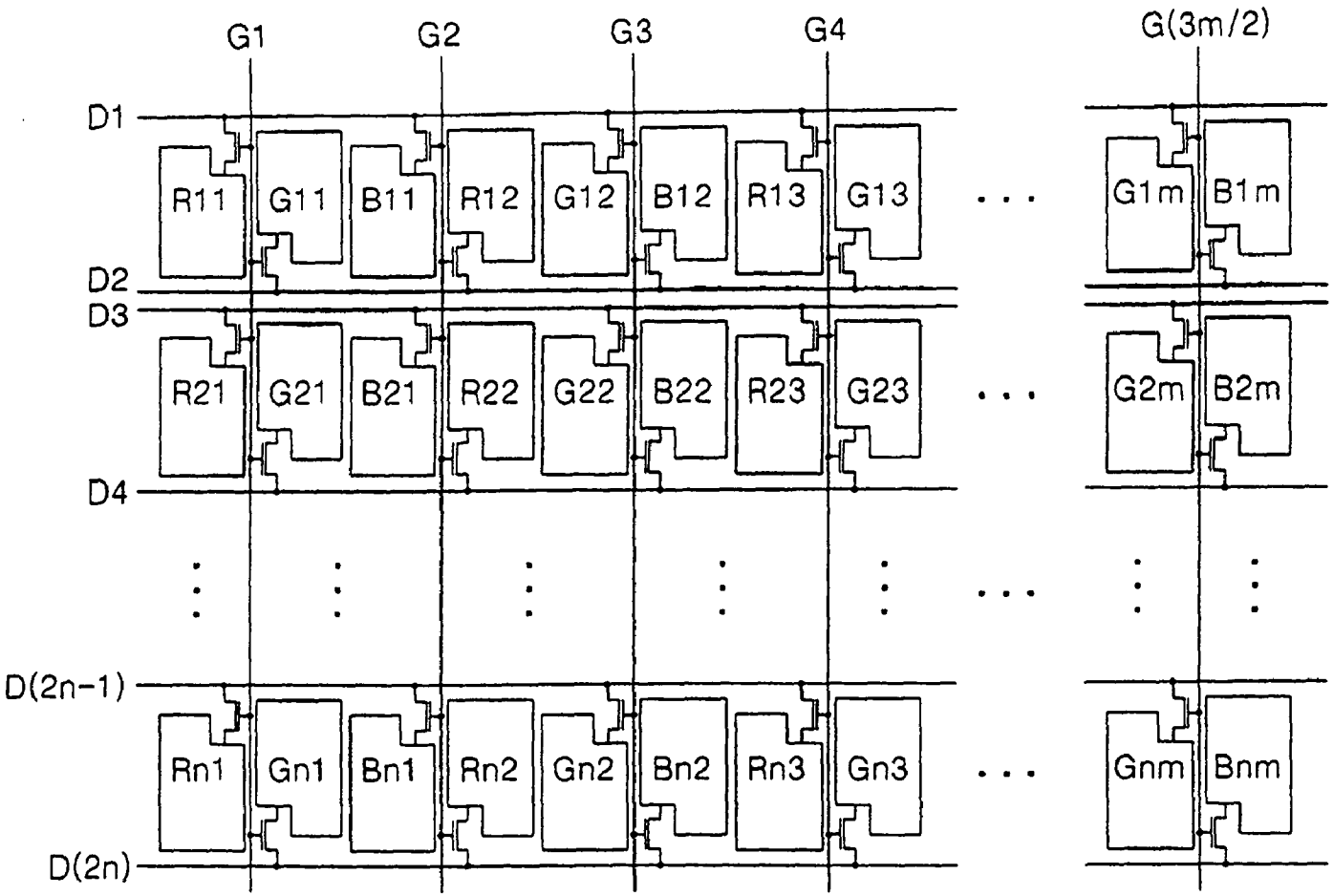
Figure 20:
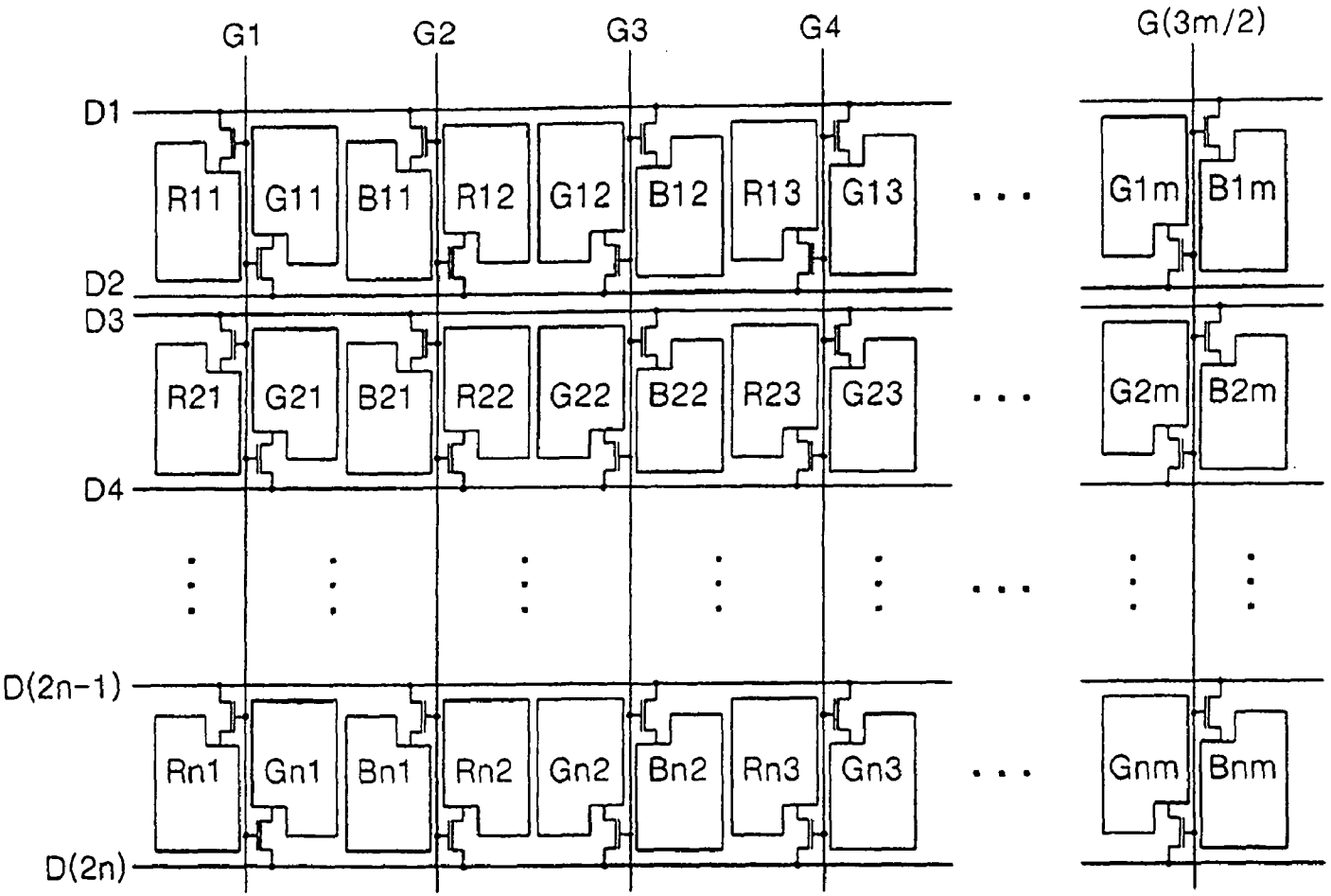

Referring to FIG. 13, if red, green and blue sub-pixels are arranged along the long-axis direction of the liquid crystal panel 6, a pulse width of each of the scan pulses corresponds to about one horizontal period (1H), and the scan pulses may be overlapped or not overlapped. As shown in FIGS. 18 and 20, when the red, green and blue sub-pixels are arranged along the short-axis direction of the liquid crystal panel 6 and the two sub-pixels being adjacent to each other use one gate line in common, the period between the point of generating the scan pulse supplied to the 'k+1'th gate line ('k' is an integer above 0) and the point of generating the scan pulse supplied to the 'k+3'th gate line satisfies about one horizontal period (1H). For the realization of the pre-charging effect of data to obtain the charging time of liquid crystal cell, the scan pulses generated in one horizontal period (1H) may be overlapped or not overlapped.

Also, source drive integrated circuits ICs 1*a* and 1*b* include a register, a shift register, a latch 120, a digital-to-analog converter (hereinafter, referred to as "DAC"), and an output buffer. The source drive integrated circuits ICs 1*a* and 1*b* sample and latch digital video data RGB input through the FPC 5, converts the sampled and latched data to analog gamma compensation voltages, and supplies the analog gamma compensation voltages to the data lines D1 to Dn. Since the data lines D1 to Dn are arranged along the short-axis direction of the liquid crystal panel 6, the source drive integrated circuits ICs 1*a* and 1*b* sample the data from the uppermost pixel of the pixel array 10 to the lowermost pixel of the pixel array 10, or reversely. The data voltage from the source drive integrated circuits ICs 1*a* and 1*b* is generated by the unit of ⅓ horizontal period, ½ horizontal period or one horizontal period in synchronization with the scan pulse. Also, the timing controller 3, a level shifter 7, a DC-DC converter and a gamma reference voltage generation circuit are mounted on the source PCB 4.

The timing controller 3 generates a gate control signal GDC to control the gate driving circuit 33 and a data control signal DDC to control the data driving circuit 32 by using vertically and horizontally synchronized signals Vsync, Hsync and clock CLK. The data control signal DDC includes a source start pulse SSP, a source shift clock SSC, a source output signal SOE and a polarity control signal POL. The gate control signal GDC includes a gate shift clock, a gate output signal and a gate start pulse.

Figure 10:
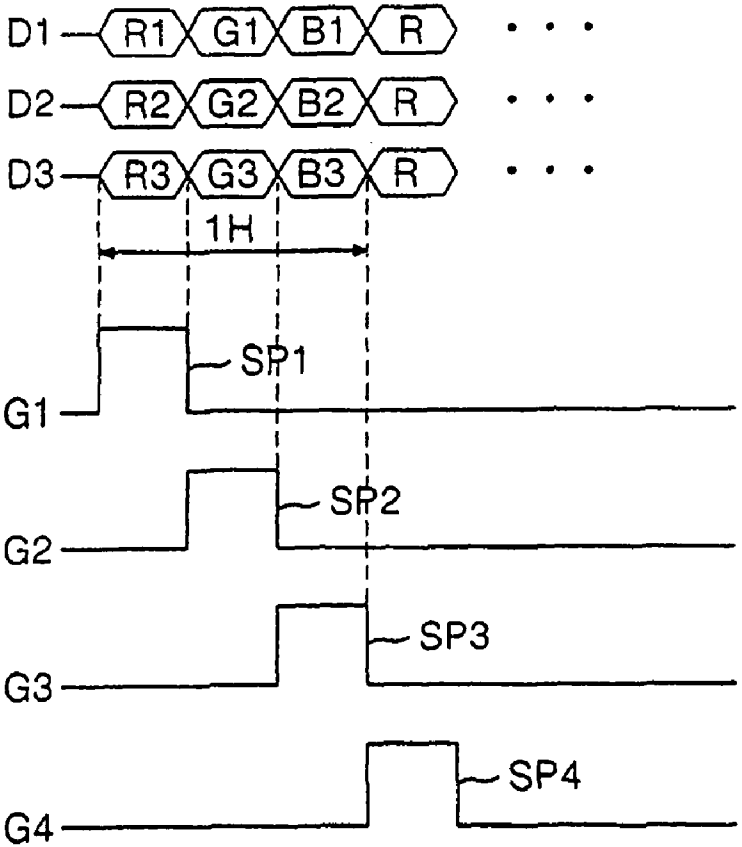
FIG. 10 is a waveform diagram of illustrating a scan pulse and a data voltage to drive a pixel array of FIG. 9.

On the assumption that the period between the point of generating the 'k+1'th scan pulse and the point of generating the 'k+4'th scan pulse satisfies one horizontal period, if the pulse width of scan pulse is smaller than one horizontal period (1H), the gate control signal GDC and data control signal DDC are modulated by the timing controller 3 such that frequencies of the gate control signal GDC and data control signal DDC are more rapid than a preset reference frequency, as shown in FIG. 10. On the assumption that the period between the point of generating the 'k+1'th scan pulse and the point of generating the 'k+3'th scan pulse satisfies one horizontal period (1H), if the pulse width of scan pulse is smaller than one horizontal period (1H), the gate control signal GDC and data control signal DDC are modulated by the timing controller 3 such that frequencies of the gate control signal GDC and data control signal DDC are more rapid than the preset reference frequency.

Also, the timing controller 3 re-aligns the digital video data RGB according to the data sampling order of the data line, the liquid crystal cell and the source drive integrated circuits ICs 1*a* and 1*b* included in the pixel array 10. The level shifter 7 receives and shifts high-potential and low-potential input voltages (constant voltages), thereby generating gate high voltage VGH and gate low voltage VLH whose swing widths are increased by an operation voltage of thin film transistor TFT. The FPC 5 is connected to output pads of the source PCB 5 and signal pads of the liquid crystal panel 6, wherein the signal pads of the liquid crystal panel 6 are electrically connected to input terminals of the source drive integrated circuits ICs 1*a* and 1*b* and the gate driving circuit 2. Thus, various control signals, gate high and low voltages and data voltage output from the source PCB 5 are transmitted to the source drive integrated circuits ICs 1*a* and 1*b* and the gate driving circuit 2.

FIG. 9 is a diagram of illustrating the first embodiment of pixel array shown in FIG. 8. Referring to FIG. 9, the pixel array 10 includes the data lines D1 to Dn arranged along the short-axis direction (y) of the liquid crystal panel 6 on the TFT array substrate, and the gate lines G1 to Gm arranged along the long-axis direction (x) of the liquid crystal panel 6 on the TFT array substrate. On the color filter array substrate of the pixel array 10, red, green and blue color filters are arranged along the short-axis direction (y) of the liquid crystal panel 6. Thus, the red, green and blue sub-pixels of the pixel array 10 are arranged along the short-axis direction (y) of the liquid crystal panel 6.

FIG. 10 is a waveform diagram of illustrating a scan pulse and a data voltage to drive a pixel array of FIG. 9. Referring to FIG. 10, the gate driving circuit 2 sequentially generates the scan pulses which are smaller than one horizontal period (1H), and supplies the generated scan pulses to the gate lines G1 to Gm. On the assumption that the period between the point of generating the 'k+1'th scan pulse and the point of generating the 'k+4'th scan pulse satisfies one horizontal period, the pulse width of each of scan pulses is smaller than one horizontal period (1H). In synchronization with the scan pulse, the source drive integrated circuits ICs 1*a* and 1*b* firstly output the red data voltages R1 to R4 for one line to the respective data lines D1 to Dn during about ⅓ horizontal period (⅓ H), secondly output the green data voltages G1 to G4 for one line to the respective data lines D1 to Dn during about ⅓ horizontal period (⅓ H), and thirdly output the blue data voltages B1 to B4 for one line to the respective data lines D1 to Dn during about ⅓ horizontal period (⅓ H).

In the driving method of the liquid crystal display device according to the first embodiment of the present disclosure, the data lines D1 to Dn are arranged along the short-axis direction (y) of the liquid crystal panel 6, and the sub-pixels are arranged in order of red, green and blue colors along the long-axis direction (x) of the liquid crystal panel 6, as shown in FIG. 9. In this case, the period of generating the data voltage is decreased to about ⅓ as compared with that of the related art driving method, so that the data voltages corresponding to the respective colors of the red, green and blue sub-pixels are supplied during one horizontal period (1H).

Figure 1:
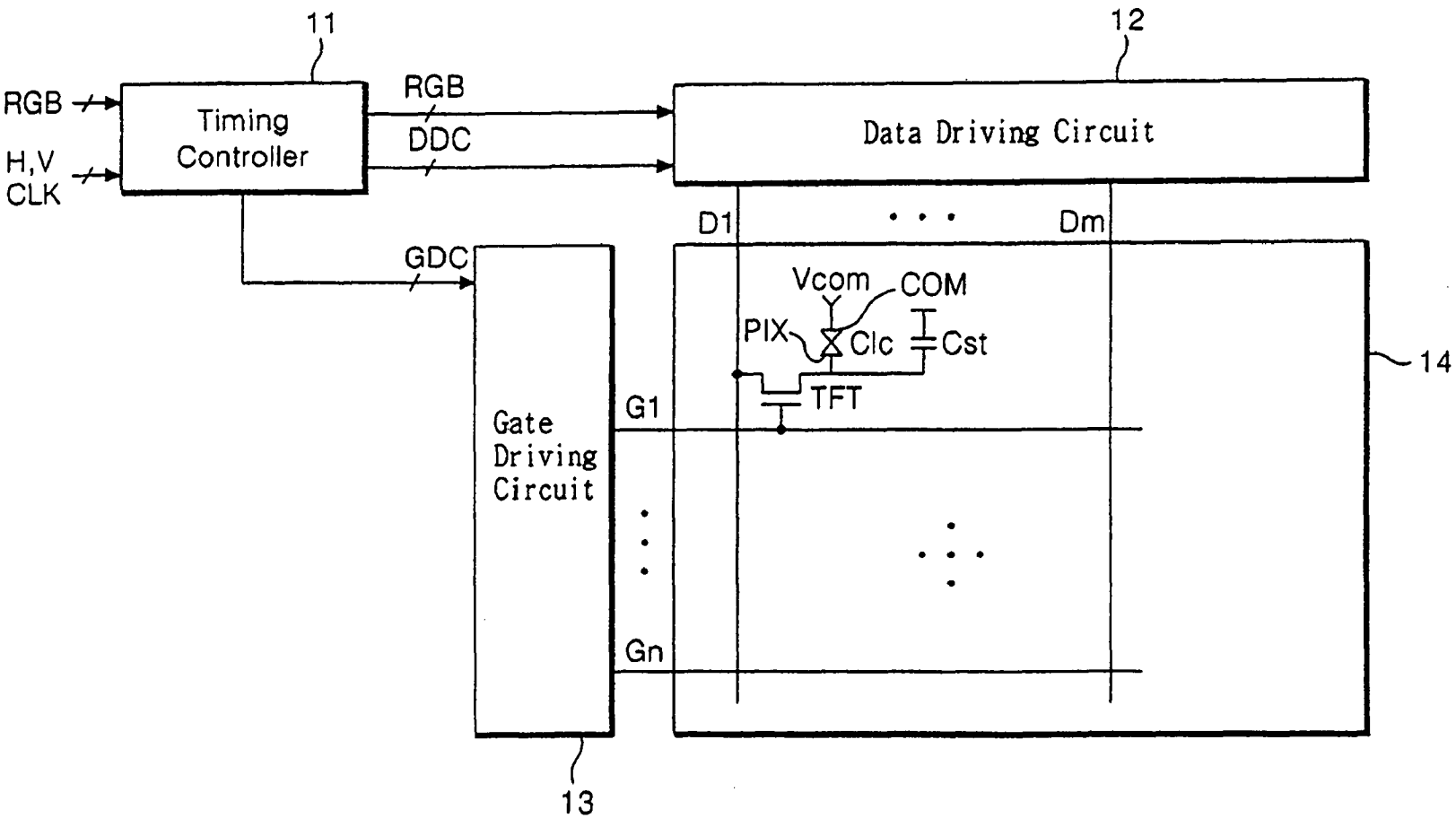
FIG. 1 RELATED ART
FIG. 1 is a block diagram of illustrating a liquid crystal display device according to the related art.
Figure 2:
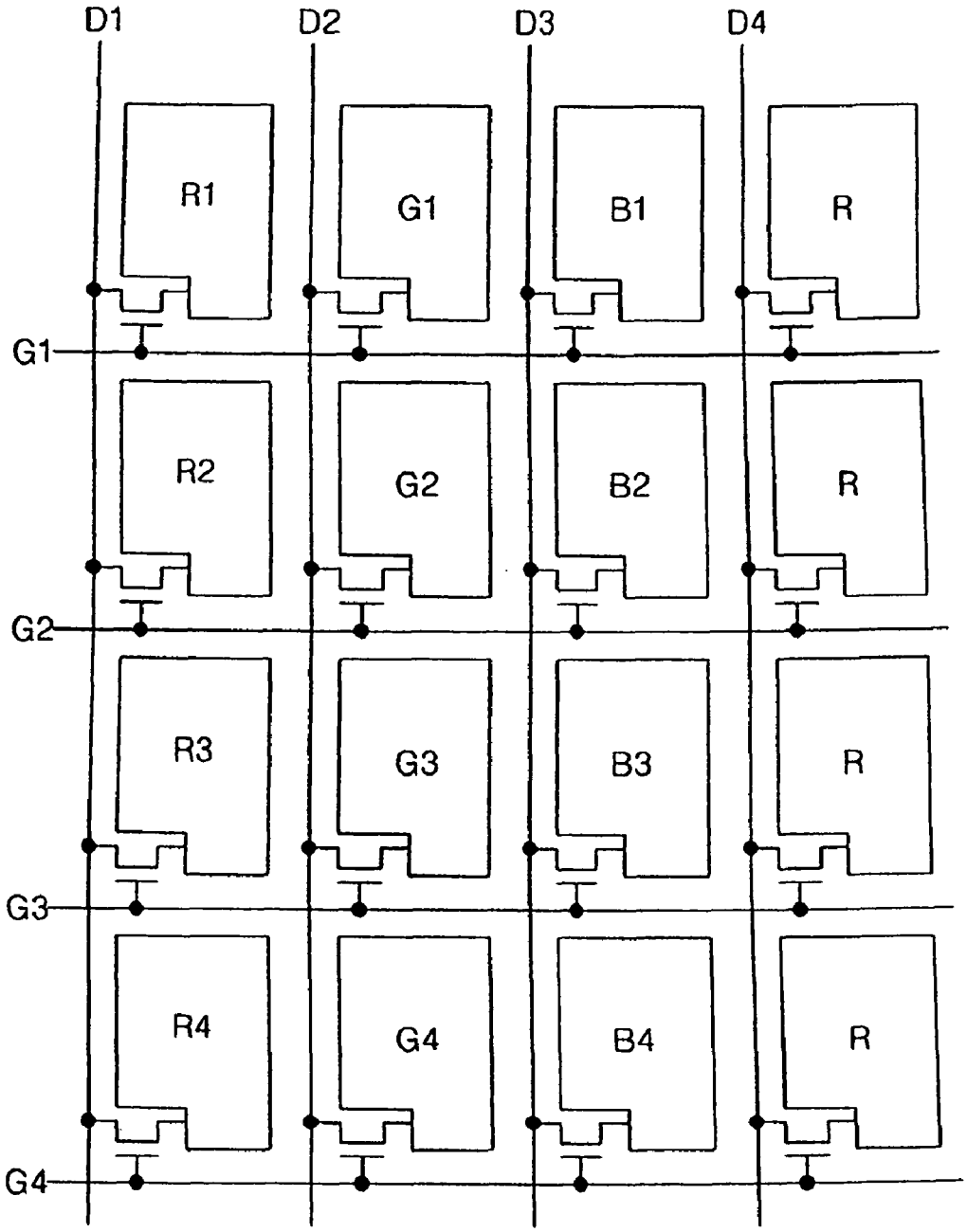
FIG.2 RELATED ART
FIG. 2 is an equivalent circuit diagram of equivalently illustrating a thin film transistor TFT array substrate with a '4×4' matrix of liquid crystal cells in a liquid crystal panel shown in FIG. 1.
Figure 3:
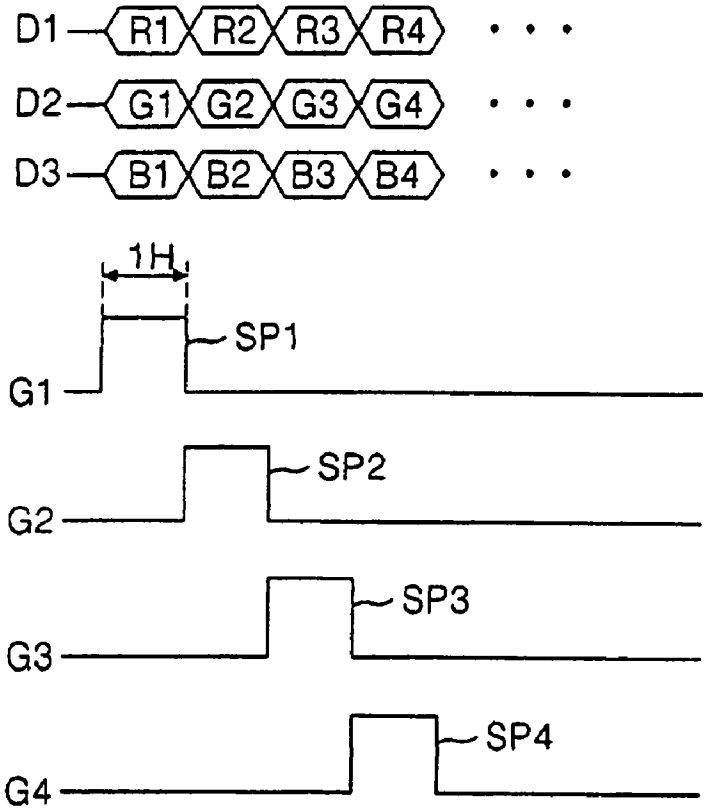
FIG. 3 RELATED ART
FIG. 3 is a waveform diagram of illustrating signals supplied to gate and data lines shown in FIG. 1.
Figure 4:
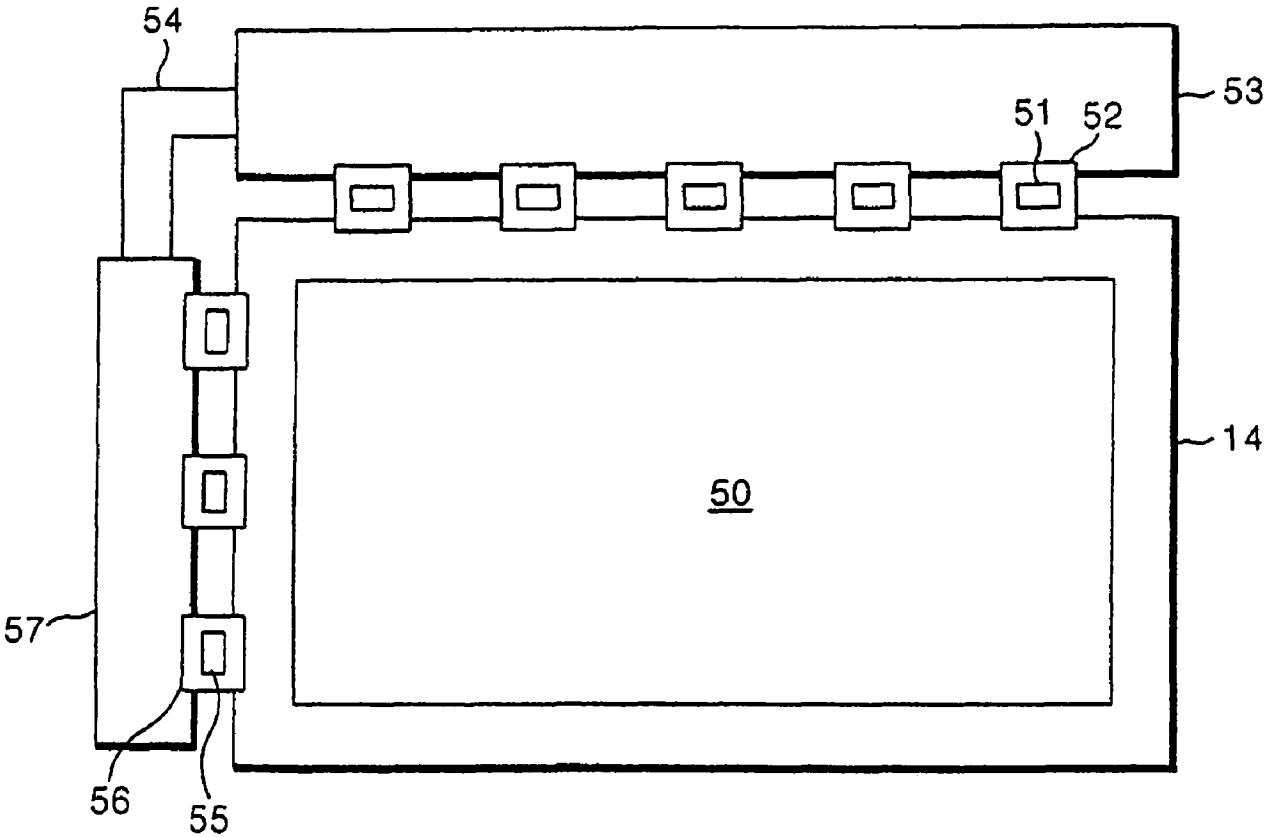
FIG. 4 RELATED ART
FIG. 4 is a diagram of illustrating source and gate drive integrated circuits adhered to a glass substrate by a Tape Automated method.
Figure 5:
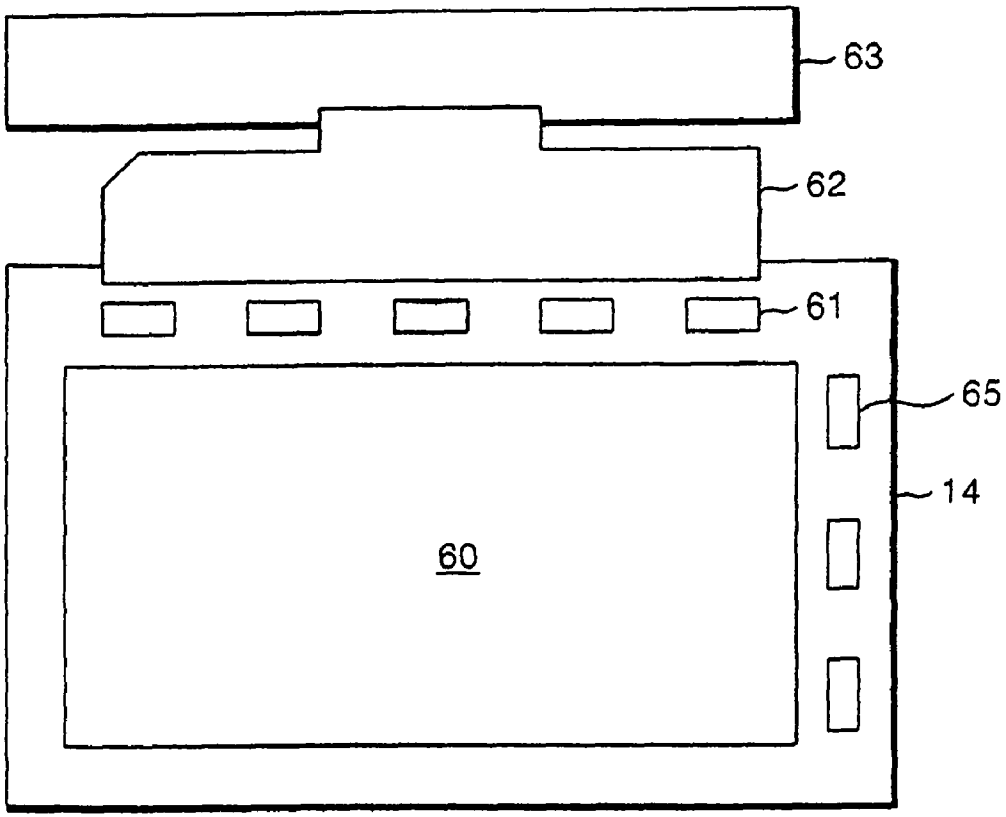
FIG. 5 RELATED ART
FIG. 5 is a diagram of illustrating source and gate drive integrated circuits adhered to a glass substrate by a Chip-On-Glass method.
Figure 6:
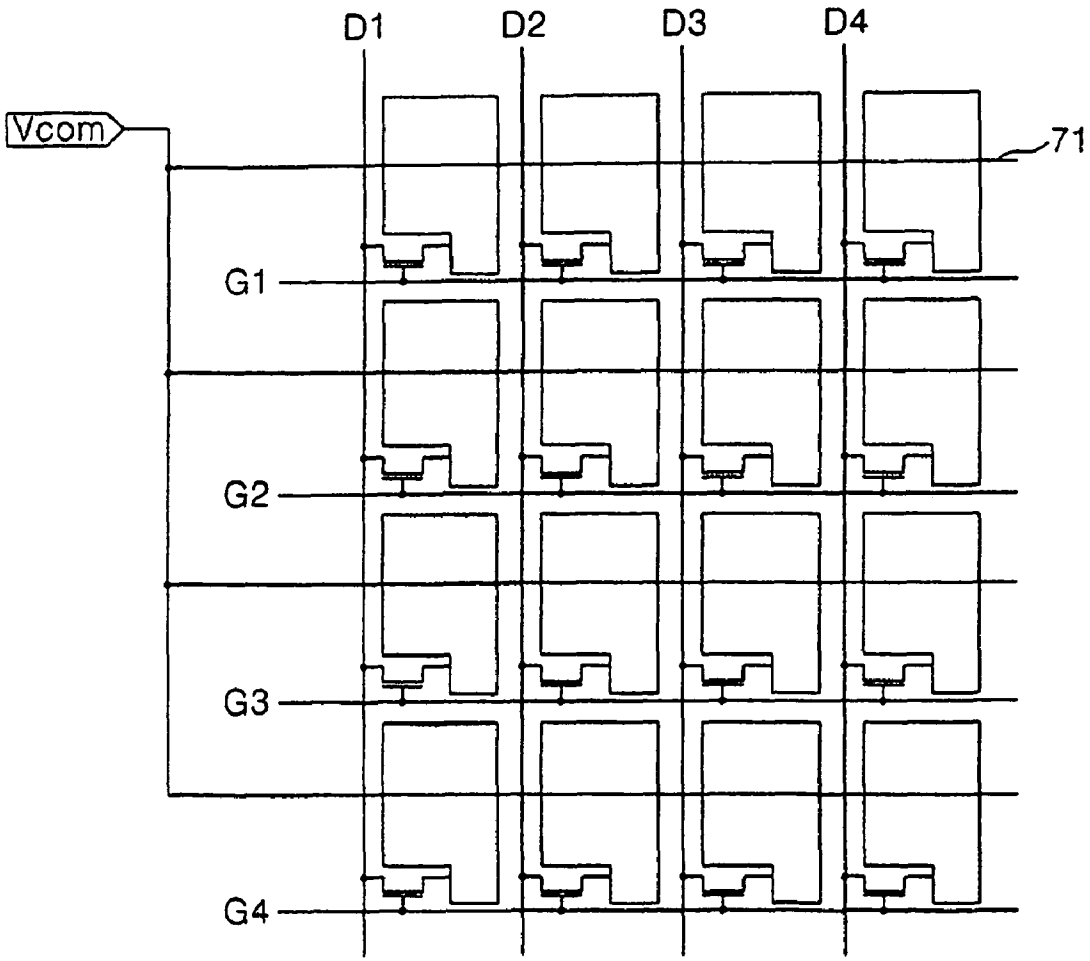
FIG. 6 RELATED ART
FIG. 6 is an exemplary diagram of illustrating the crossing of data lines and a common electrode in a Storage-On-Common method.
Figure 7:
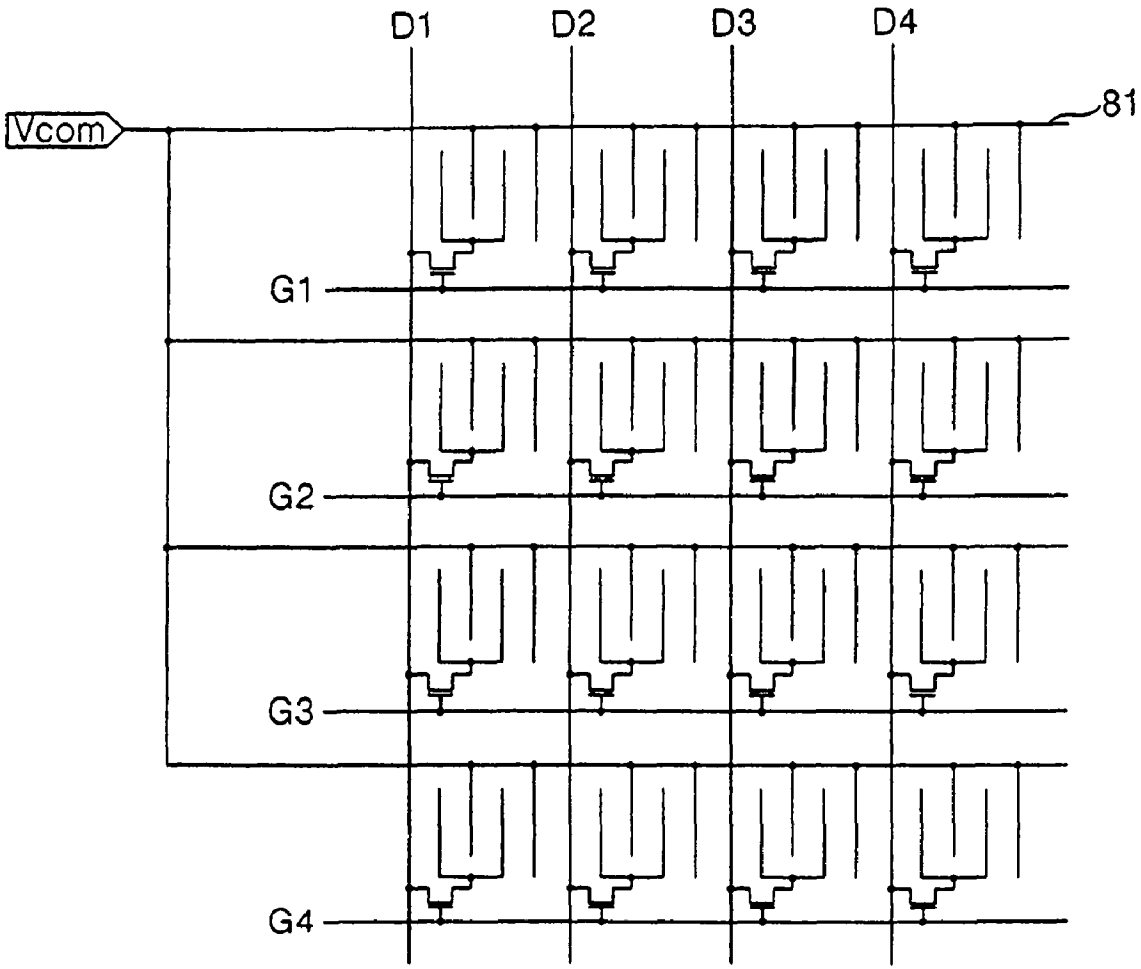
FIG. 7 RELATED ART
FIG. 7 is an exemplary diagram of illustrating the crossing of data lines and a common electrode in an In-Plane Switching mode.

In order to supply the data voltage to the data lines D1 to Dn as shown in FIG. 10, the order of supplying the data to the source drive integrated circuits ICs 1*a* and 1*b* is different from the order of supplying data to signal lines as shown in FIG. 2. For this, the driving method of liquid crystal display device according to the first embodiment of the present disclosure necessarily requires the re-alignment of data with reference to the arrangement of signal lines and sub-pixels shown in FIG. 9 in the timing controller 3 or a graphic card of an external system to supply the digital video data to the timing controller 3 through an interface circuit. Among the graphic cards recently obtainable on the market, there is the graphic card which can offer a Pivot function to align data as "portrait mode" as well as to align data as "landscape mode", which enables the data output of FIG. 3 with reference to the arrangement of signal lines and sub-pixels of the related art shown in FIG. 2. In this graphic card, if selecting the Pivot function as "portrait mode" option, it is possible to obtain the data output of FIG. 10.

Figure 11:
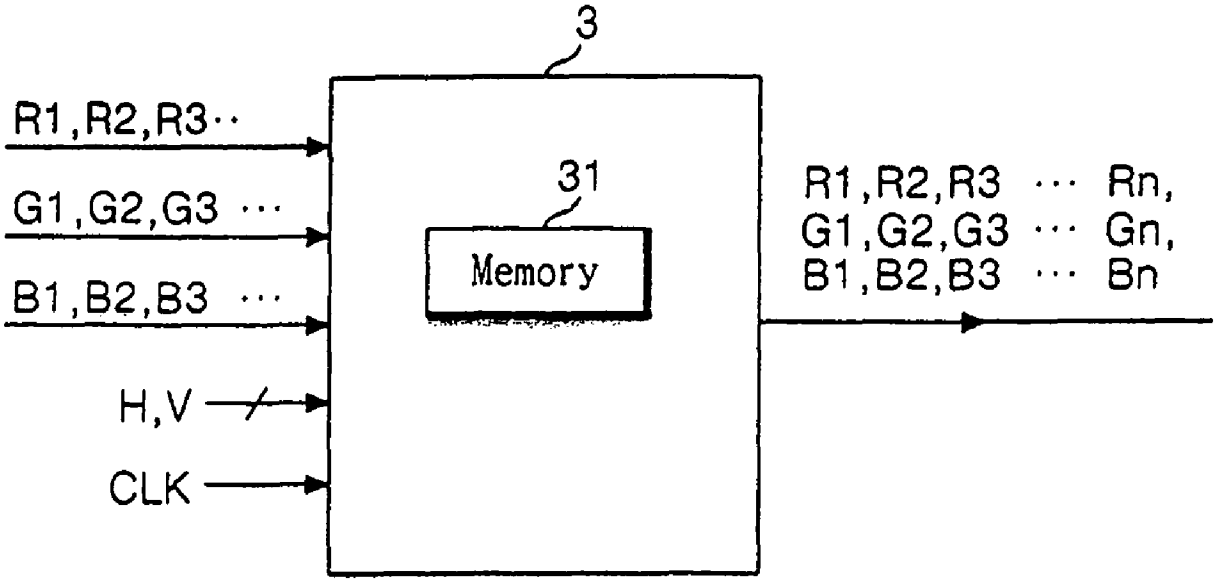
FIG. 11 is an exemplary diagram of illustrating a timing controller to align digital video data according to an arrangement of signal line and sub-pixel of FIGS. 9 and 10.

FIG. 11 illustrates one example of timing controller 3 to align digital video data to be suitable for the arrangement of signal lines and sub-pixels of FIGS. 9 and 10. Referring to FIG. 11, the timing controller 3 includes a memory 31. The memory 31 is supplied with red digital video data input in order of R1, R2, R3 . . . through a first data input line, green digital video data input in order of G1, G2, G3 . . . through a second data input line, and blue digital video data input in order of B1, B2, B3 . . . through a third data input line. Under the control of a memory controller (not shown), the memory 31 re-aligns the data, and outputs the re-aligned data in order of R1, R2, R3 . . . Rn, G1, G2, G3 . . . Gn, B1, B2, B3 . . . Bn through the data output lines. The output speed of digital video data output from the memory 31 becomes three times as rapid as the related art, so that the period thereof is reduced to ⅓ of the input data from the timing controller 3.

Figure 12:
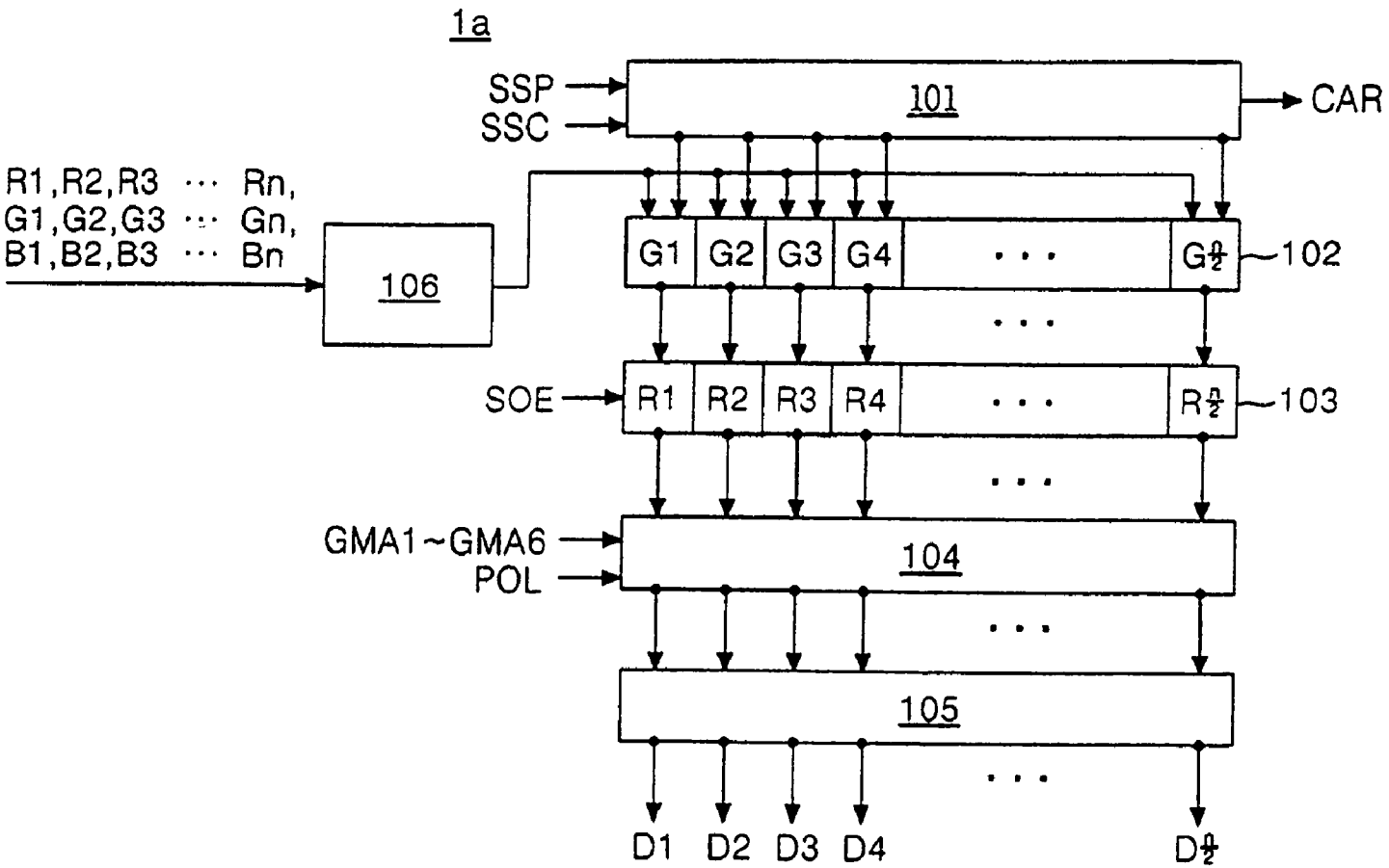
FIG. 12 is a block diagram of illustrating a source drive integrated circuit for the supply of data according to the first embodiment of the present disclosure.

FIG. 12 illustrates the structure and operation of source drive integrated circuits ICs 1*a* and 1*b* for the supply of data shown in FIG. 10, which details the first source drive integrated circuit IC 1*a*. Referring to FIG. 12, the first source drive integrated circuit IC 1*a* includes a shift register 101, a first latch 102, a second latch 103, a DAC 104, an output buffer 105, and a register 106.

The register 106 temporarily stores the digital video data RGB from the timing controller 3, and supplies the digital video data RGB to the first latch 102. The shift register 101 generates a sampling signal by shifting the source start pulse SSP output from the timing controller 3 according to the source shift clock signal SSC. Also, the shift register 101 shifts the source start pulse SSP and transmits a carry signal CAR to an integrated circuit of the next terminal. The first latch 102 sequentially samples and latches the digital video data RGB according to the sampling signal output from the shift register 101, and supplies the latched digital video data RGB to the second latch 103, at the same time.

The second latch 103 latches the data from the first latch 102 until the last data of first line, that is, the 'n'th data is latched in the second latch of second source drive integrated circuit IC 1*b*. Then, the second latch 103 responds to the source output signal SOE which output speed is three times as rapid as the related art, and outputs the digital video data latched simultaneously with the second latch of second source drive integrated circuit IC 1*a*. Also, the DAC 104 converts the digital video data RGB from the second latch 104 into positive and negative polarity analog data voltages by using gamma reference voltages GMA1 to GMA6. The output buffer 105 is connected to the respective data lines D1 to Dn/2, to thereby decrease the loss of data voltages supplied to the data lines D1 to Dn/2 from the DAC 104.

FIG. 13 is a diagram of illustrating the second embodiment of pixel array shown in FIG. 8. Referring to FIG. 13, the pixel array 10 includes the data lines D1 to Dn arranged along the short-axis direction (y) of the liquid crystal panel 6 on the TFT array substrate, and the gate lines G1 to Gm arranged along the long-axis direction (x) of the liquid crystal panel 6 on the TFT array substrate. On the color filter array substrate of the pixel array 10, red, green and blue color filters are arranged along the long-axis direction (x) of the liquid crystal panel 6. Thus, the red, green and blue sub-pixels of the pixel array 10 are arranged along the long-axis direction (x) of the liquid crystal panel 6. Thus, the red, green and blue sub-pixels of the pixel array 10 are arranged along the long-axis direction (x) of the liquid crystal panel 6.

Figure 14:
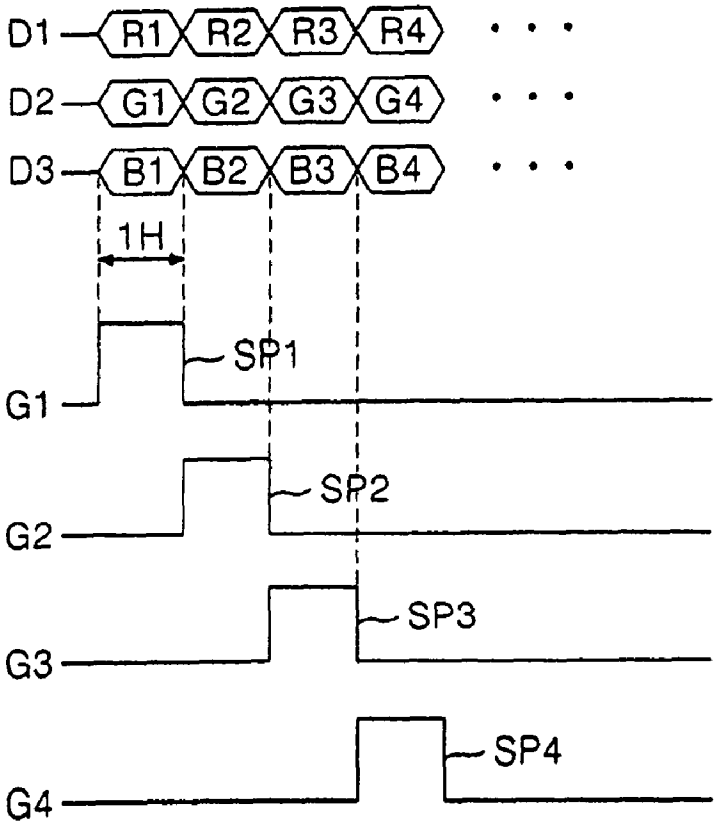
FIG. 14 is a waveform diagram of illustrating a scan pulse and a data voltage to drive a pixel array of FIG. 13.

FIG. 14 is a waveform diagram of illustrating a scan pulse and a data voltage to drive the pixel array of FIG. 13. As shown in FIG. 14, the gate driving circuit 2 sequentially generates the scan pulse, each of which has a pulse width of about one horizontal period (1H), and supplies the scan pulses to the gate lines G1 to Gm. In synchronization with the scan pulse, the source drive integrated circuits ICs 1*a* and 1*b* output red, green and blue data voltages for one line to the respective data lines D1 to Dn during about one horizontal period (1H), and then outputs red, green and blue data voltages for the next line to the respective data lines D1 to Dn.

In the driving method of the liquid crystal display device according to the second embodiment of the present disclosure, the data lines D1 to Dn are arranged along the short-axis direction (y) of the liquid crystal panel 6, and the sub-pixels are arranged in order of red, green and blue colors along the short-axis direction (y) of the liquid crystal panel 6, as shown in FIG. 13. Thus, the pulse width of scan pulse and the period of generating the data voltage are controlled to about one horizontal period (1H). The data supplying method of FIG. 14 is virtually identical to that of FIG. 3, whereby the data supplying method of FIG. 14 doesn't require the re-alignment of data and the change of driving frequency.

Figure 15:
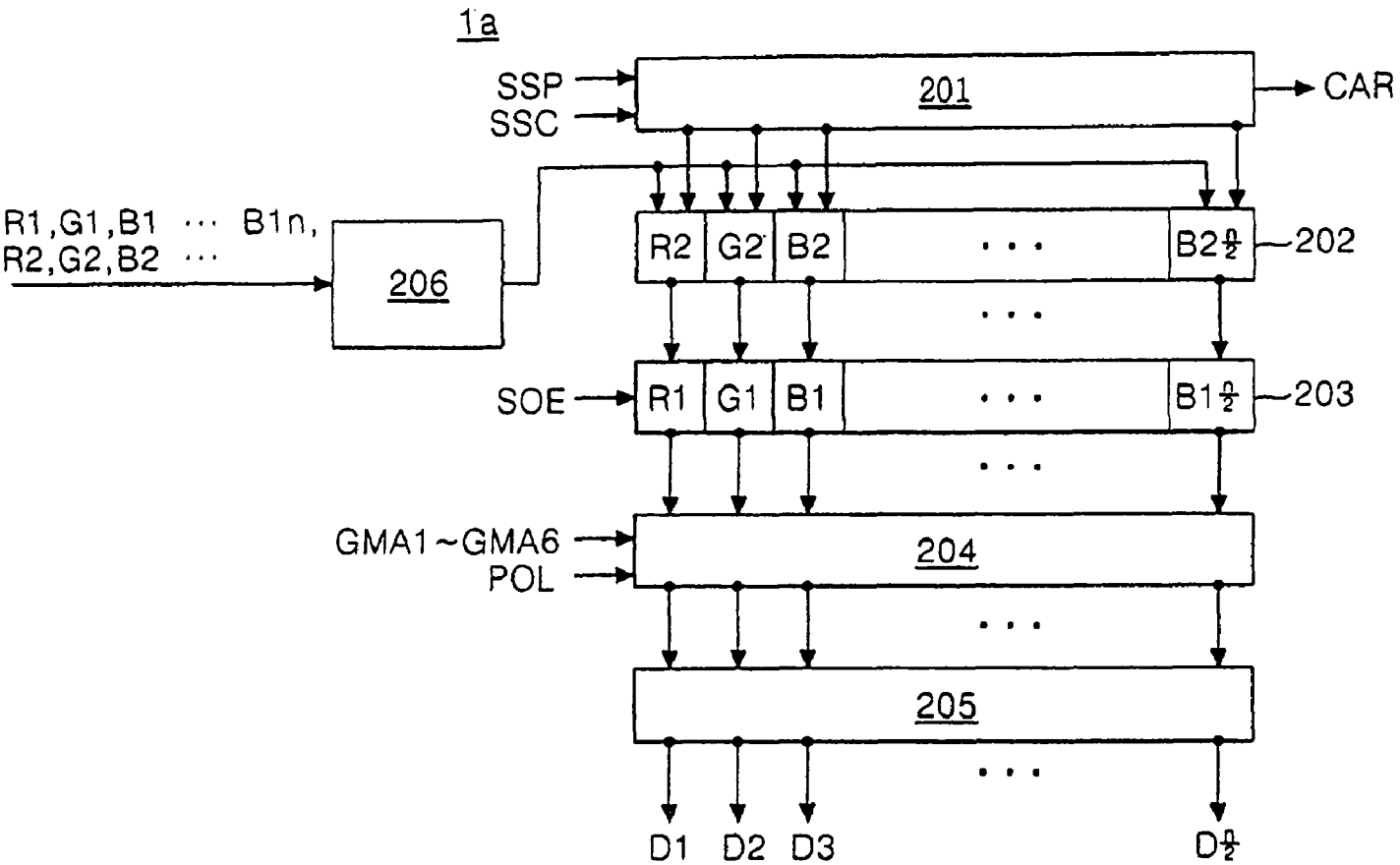
FIG. 15 is a block diagram of illustrating a source drive integrated circuit for the generation of data voltage of FIG. 14 according to the second embodiment of the present disclosure.

FIG. 15 illustrates the structure and operation of source drive integrated circuits ICs 1*a* and 1*b* to generate the data voltage of FIG. 14, which details the first source drive integrated circuit IC 1*a*. Referring to FIG. 15, the first source drive integrated circuit IC 1*a* includes a shift register 201, a first latch 202, a second latch 203, a DAC 204, an output buffer 205, and a register 206. Since digital video data output from the timing controller is input to the first source drive integrated circuit IC 1*a* in order of R1, G1, B1 . . . R2, G2, B2 . . . , the digital video data is aligned in order of R, G and B colors from the left side to the right side of each of the first and second latches 202 and 203.

Figure 16:
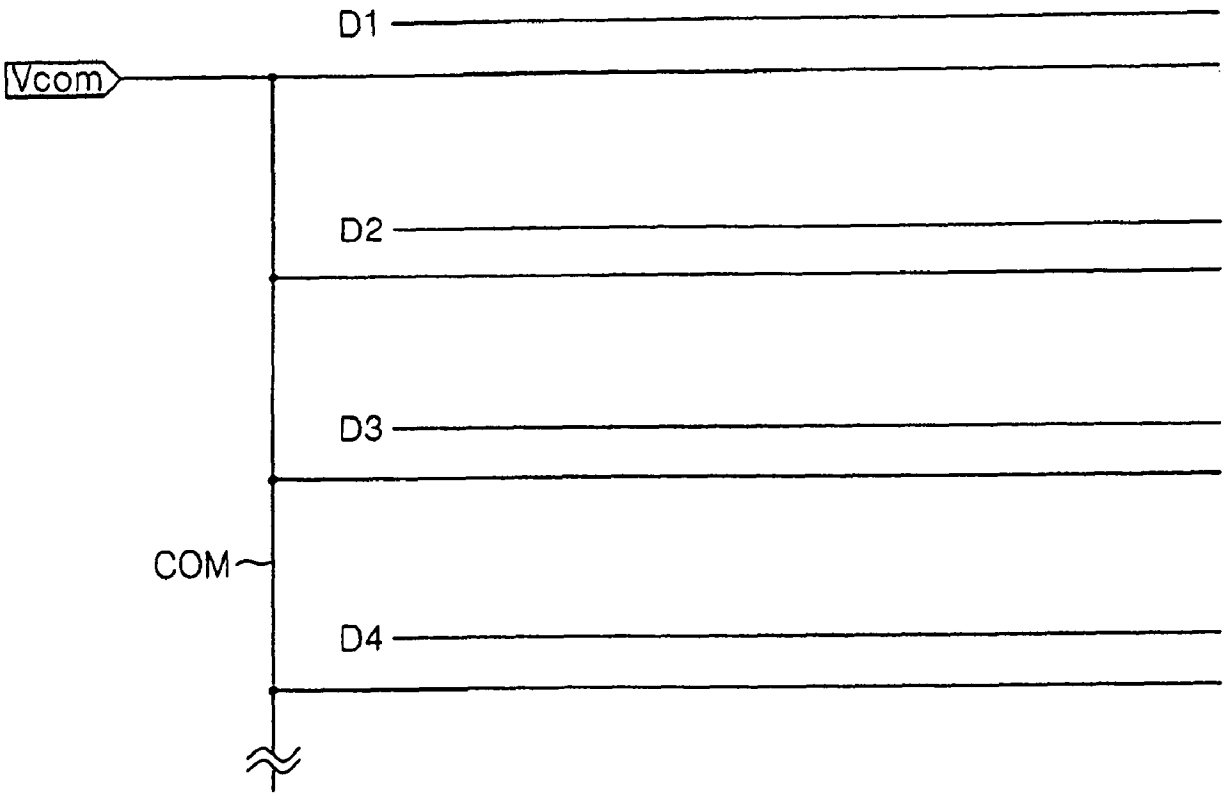
FIG. 16 is a diagram of illustrating a common electrode for supplying a common voltage to a common electrode of liquid crystal cell in a liquid crystal display device according to the preferred embodiment of the present disclosure and a driving method thereof.

FIG. 16 is a diagram of illustrating a common electrode for supplying a common voltage Vcom to a common electrode COM of liquid crystal cell in a liquid crystal display device according to the preferred embodiment of the present disclosure and a driving method thereof. Referring to FIG. 16, a common voltage supplying line COML is arranged at the same direction as the data lines D1 to Dn, that is, along the short-axis direction (y) of liquid crystal panel 6. Thus, the common voltage supplying line COML is formed in parallel to the data lines D1 to Dn on the TFT array substrate of liquid crystal panel 6, without crossing the data lines D1 to Dn. Accordingly, a common voltage Vcom is not affected by the data voltage, whereby the common voltage Vcom is not changed by the data voltage.

Figure 17:
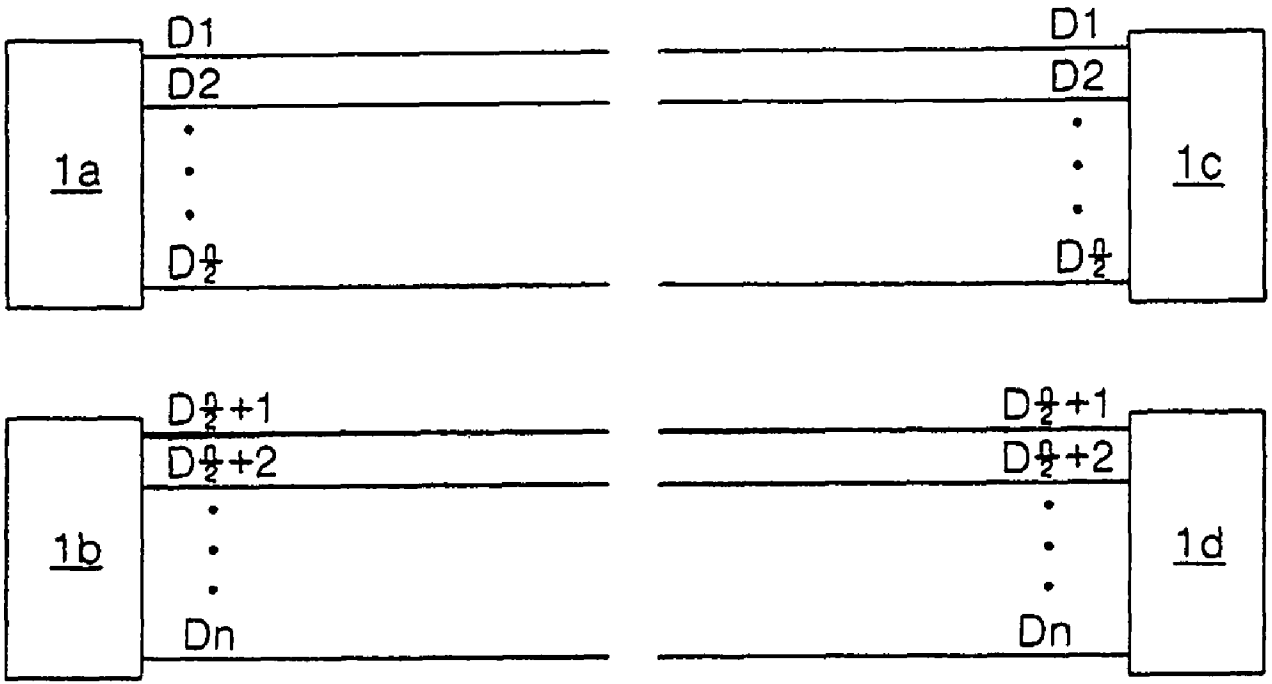
FIG. 17 is a diagram of illustrating a data line and a source drive integrated circuit included in a liquid crystal display device according to another embodiment of the present disclosure.

The liquid crystal display device according to the preferred embodiment of the present disclosure includes the 'n' data lines D1 to Dn arranged along the short-axis direction (y) of liquid crystal panel 6 in parallel, wherein each of the data lines D1 to Dn is positioned along the long-axis direction (x) of liquid crystal panel 6. According as the data lines D1 to Dn are increased in length, resistance and parasitic capacitance of the data line are also increased so that RC delay of the data voltage is increased. To decrease the RC delay, the data lines D1 to Dn may be formed of low-resistance metal, for example, copper Cu. In another method, for the decrease of the RC delay, the data lines D1 to Dn may be divided into the left and right parts, and the left and right parts of the data lines D1 to Dn are respectively driven by the different source drive integrated circuits ICs 1*a* to 1*d*. Even though the method of FIG. 17 is applied, it is possible to decrease the number of source drive integrated circuits ICs as compared with the related art having the same resolution. For example, if the related art liquid crystal display device is provided with the data lines arranged as XGA resolution (1024*768), it requires five source drive integrated circuits ICs having 618 output channels. In the meantime, the liquid crystal display device with the same resolution according to the present disclosure requires four source drive integrated circuits ICs.

FIGS. 18 and 20 illustrate the third embodiment of pixel array shown in FIG. 8. Referring to FIG. 18, the pixel array 10 according to the third embodiment of the present disclosure includes the data lines D1 to D2*n* arranged along the short-axis direction (y) of liquid crystal panel 6 on the TFT array substrate, and the gate lines G1 to G3*m*/2 arranged along the long-axis direction (x) of liquid crystal panel 6 on the TFT array substrate.

On the color filter array substrate of the pixel array 10 according to the third embodiment of the present disclosure, red, green and blue color filters are arranged along the short-axis direction (y) of the liquid crystal panel 6. Thus, the red, green and blue color sub-pixels of the pixel array 10 are arranged along the short-axis direction (y) of the liquid crystal panel 6. When the two sub-pixels being adjacent to each other use one gate line in common, the sub-pixels R11 to Rn1, B11 to Bn1, G12 to Gn2, R13 to Rn3, . . . G1*m* to Gnm positioned at the left side of the gate lines G1 to G(3m/2) are supplied with data from the odd numbered data lines D1, D3, . . . D(2n−1). When the two sub-pixels being adjacent to each other use one gate line in common, the sub-pixels G11 to Gn1, R12 to Rn2, B12 to Bn2, G13 to Gn3 . . . B1*m* to Bnm positioned at the right side of the gate lines G1 to G(3m/2) are supplied with data from the even numbered data lines D2, D4, . . . D2*n*.

For this, when the thin film transistor is formed at the left-side portion of the crossing between the gate line used in common and the odd numbered data line, the thin film transistor is switched-on so as to apply data from the odd numbered data line to the sub-pixels positioned at the left side of the gate lines. Also, when the thin film transistor is formed at the right-side portion of the crossing between the gate line used in common and the even numbered data line, the thin film transistor is switched-on so as to apply data from the even numbered data line to the sub-pixels positioned at the right side of the gate lines.

In the pixel array 10 according to the third embodiment of the present disclosure, one pixel is comprised of R, G and B sub-pixels, wherein two of the R, G and B sub-pixels are supplied with data from the odd numbered (or even numbered) data line, and the other thereof is supplied with data from the even numbered (or odd numbered) data line. Accordingly, the pixel array 10 according to the third embodiment of the present disclosure is not limited to FIG. 18. The pixel array 10 according to the third embodiment of the present disclosure may be formed with various modifications, for example, the structure of FIG. 20.

As shown in FIG. 20, the pixel array 10 according to the third embodiment of the present disclosure includes the data lines D1 to D2*n* arranged along the short-axis direction (y) of liquid crystal panel 6 on the TFT array substrate, and the gate lines G1 to G3*m*/2 arranged along long-axis direction (x) of liquid crystal panel 6 on the TFT array substrate. On the color filter array substrate of the pixel array 10, red, green and blue color filters are arranged along the short-axis direction (y) of the liquid crystal panel 6. Thus, the red, green and blue sub-pixels of the pixel array 10 are arranged along the short-axis direction (y) of the liquid crystal panel 6.

When the two sub-pixels being adjacent to each other use one gate line in common, the '4i+1'th and '4i+2'th sub-pixels ('i' is 0 or integer) R11 to Rn1, B11 to Bn1, . . . R1(*m*−2) to Rn(m−2) positioned at the left side of the gate lines G1 to G(3m/2) are supplied with data from the odd numbered data lines; and the '4i+3'th and '4i+4'th sub-pixels G12 to Gn2, R13 to Rn3, . . . G1*m* to Gnm are supplied with data from the even numbered data lines. Also, when the two-sub-pixels being adjacent to each other use one gate line in common, the '4i+1'th and '4i+2'th sub-pixels G11 to Gn1, R12 to Rn2 . . . G1(*m*−2) to Gn(m−2) positioned at the right side of the gate lines G1 to G(3m−2) are supplied with data from the even numbered data lines; and the '4i+3'th and '4i+4'th sub-pixels B12 to Bn2, G13 to Gn3 . . . B1*m* to Bnm are supplied with data from the odd numbered data lines.

For this, when the thin film transistor is formed at the left-side portion of the crossing between the gate line used in common and the odd numbered data line, the thin film transistor is switched-on so as to apply data from the odd numbered data line to the '4i+1'th and '4i+2'th sub-pixels positioned at the left side of the gate lines. Also, when the thin film transistor is formed at the right-side portion of the crossing between the gate line used in common and the odd numbered data line, the thin film transistor is switched-on so as to apply data from the odd numbered data line to the '4i+3'th and '4i+4'th sub-pixels positioned at the right side of the gate lines.

Also, when the thin film transistor is formed at the right-side portion of the crossing between the gate line used in common and the even numbered data line, the thin film transistor is switched-on so as to apply data from the even numbered data line to the '4i+1'th and '4i+2'th sub-pixels positioned at the right side of the gate lines. Also, when the thin film transistor is formed at the left-side portion of the crossing between the gate line and the even numbered data line, the thin film transistor is switched-on so as to apply data from the even numbered data line to the '4i+3'th and '4i+4'th sub-pixels positioned at the left side of the gate lines.

Figure 19:
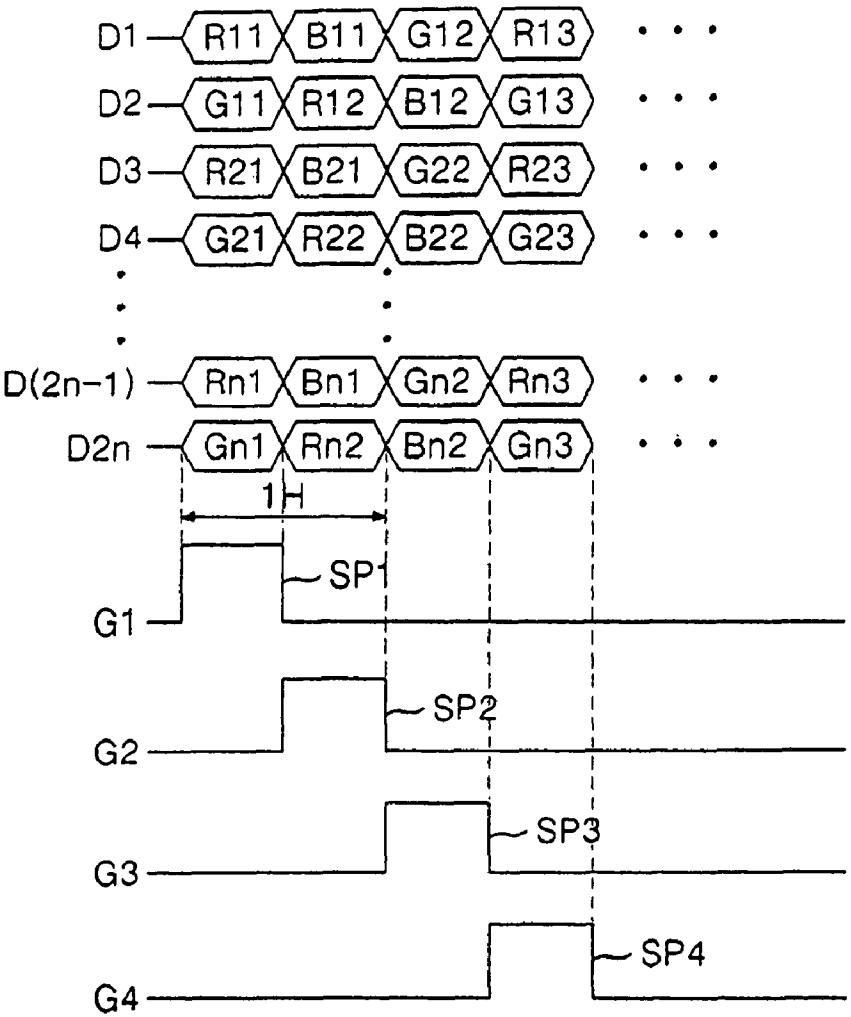
FIG. 19 is a waveform diagram of illustrating a scan pulse and a data voltage to drive a pixel array of FIG. 18.
Figure 21:
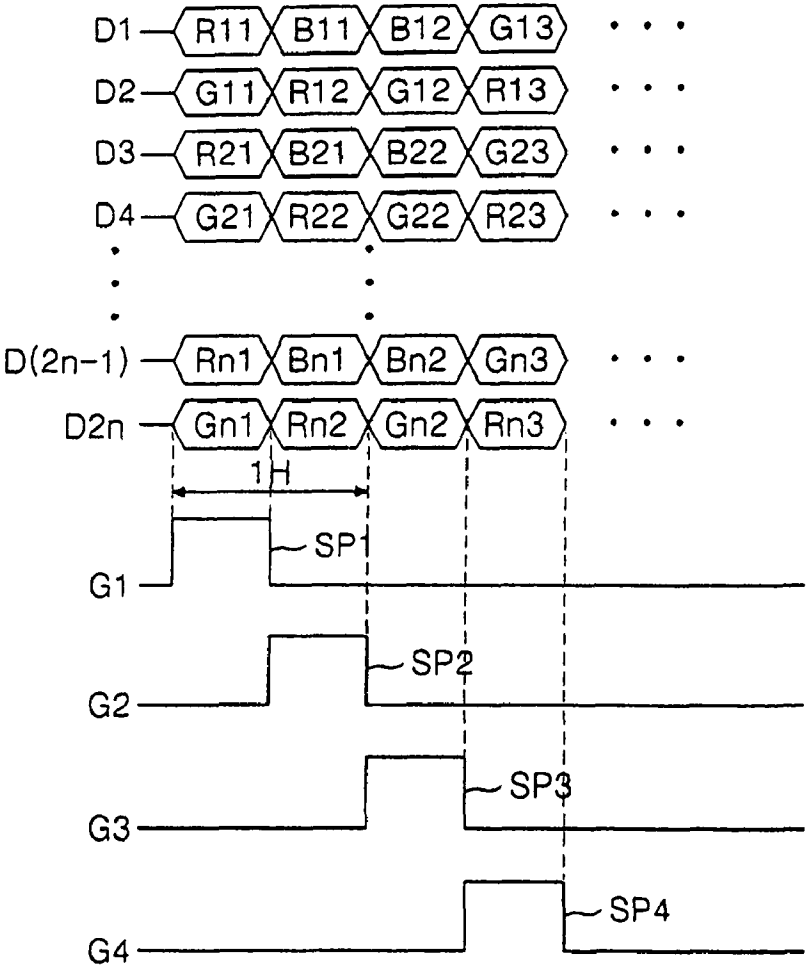
FIG. 21 is a waveform diagram of illustrating a scan pulse and a data voltage to drive a pixel array of FIG. 19.

Referring to FIGS. 19 and 21, the gate driving circuit 2 sequentially generates the scan pulses, each of which is smaller than one horizontal period (1H), and supplies the generated scan pulses to the gate lines G1 to G(3m/2). At this time, the pulse width of each of scan pulses is smaller than one horizontal period (1H) on assumption that the period between the point of generating the 'k+1'th scan pulse and the point of generating the 'k+3'th scan pulse satisfies one horizontal period (1H).

In synchronization with the scan pulse, the source drive integrated circuits ICs 1*a* and 1*b* output the data voltage to the data lines D1 to D2*n*. For example, the source drive integrated circuits ICs 1*a* and 1*b* output the red and green data voltages R11 to Gn1 for one line to the data lines during about ½ horizontal period (½ H), and then output the blue and red data voltages B11 to Rn1 for one line during about ½ horizontal period (½ H). The driving method of liquid crystal display device according to the third embodiment of the present disclosure is provided with the data lines D1 to Dn arranged along the short-axis direction (y) of liquid crystal panel 6, and the red, green and blue sub-pixels arranged along the long-axis direction (x) of liquid crystal panel 6.

Furthermore, the two sub-pixels, which use one gate line in common, are supplied with the data voltage from the odd or even numbered data line in synchronization with the scan pulse from the gate line used in common. Accordingly, the driving method of liquid crystal display device according to the third embodiment of the present disclosure can decrease the period of generating the data voltage to ½ of the related art such that the data voltages corresponding to the respective colors of the red, green and blue sub-pixels are supplied during one horizontal period.

Table 1 shows the third embodiment of the present dislosure in comparison to the related art and the first and second embodiments of the present discolure.

| | Related art | First and second embodiments | Third embodiment |
|---|---|---|---|
| The number of data lines | 1024 * 3 = 3072 | 768 | 768 * 2 = 1536 |
| The number of gate lines | 768 | 1024 * 3 = 3072 | 1024 * 3/2 = 1536 |

In the above Table 1, the number of data lines used in the liquid crystal display device according to the third embodiment of the present disclosure is reduced to the half of that of the related art. In addition, the number of gate lines used in the liquid crystal display device according to the third embodiment of the present disclosure is reduced to the half to the half of that of the first and second embodiments of the present disclosure.

Accordingly, the liquid crystal display device according to the third embodiment of the present disclosure, which has the same resolution as that of the related art, is provided with the source drive integrated circuits ICs which are decreased in number as compared with the related art. Also, even though the liquid crystal display device according to the third embodiment of the present disclosure is provided with the increased number of source drive integrated circuits ICs due to the increased number of data lines as compared with the first and second embodiments, the liquid crystal display device according to the third embodiment of the present disclosure can easily obtain the charging time of data line by decreasing the number of gate lines.

To supply the data voltage to the data lines D1 to D2*n*, as shown in FIGS. 19 and 21, the order of supplying data to the source drive integrated circuits ICs 1*a* and 1*b* is different from the order of supplying data to the signal lines of FIG. 2. For this, the driving method of liquid crystal display device according to the third embodiment of the present disclosure necessarily requires the re-alignment of data with reference to the arrangement of signal lines and sub-pixels shown in FIGS. 18 and 20 in the timing controller 3 or a graphic card of an external system to supply the digital video data to the timing controller 3 through an interface circuit.

Figure 22:
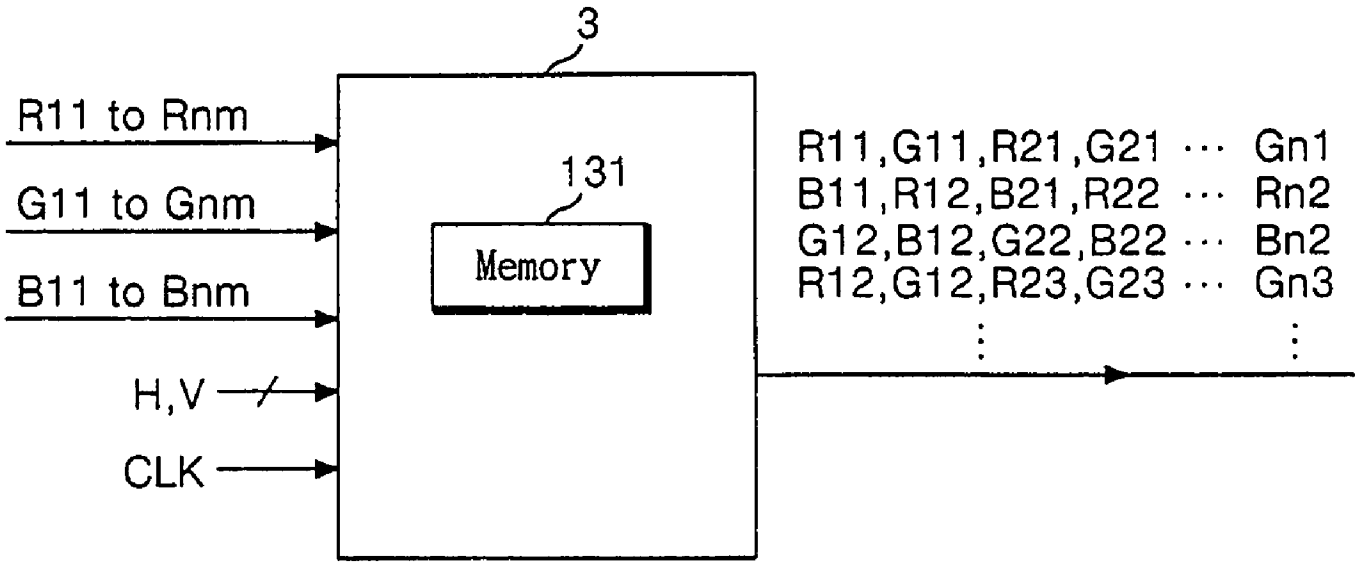
FIG. 22 is an exemplary diagram of illustrating a timing controller to align digital video data according to an arrangement of signal line and sub-pixel of FIGS. 18 and 19.

FIG. 22 is an exemplary diagram of illustrating the timing controller to align digital video data according to an arrangement of signal line and sub-pixel of FIGS. 18 and 19.

Referring to FIG. 22, the timing controller 3 includes a memory 131. The memory 131 is supplied with red digital video data input in order of R11 to Rnm through a first data input line, green digital video data input in order of G11 to Gnm through a second data input line, and blue digital video data input in order of B11 to Bnm through a third data input line. The memory 131 re-aligns the data under the control of a memory controller (not shown), and outputs the re-aligned data in order of R11, G11, R21, G21 . . . Gn1, B11, R12, B21, R22 . . . Rn2, G12, B12, G22, B22 . . . Bn2, R13, G13, R23, G23 . . . Gn3 through the data output lines. Thus, the speed of outputting the digital video data from the memory 131 is two times as rapid as the related art, so that the period of inputting data of timing controller 3 is shorter to ½.

Figure 23:
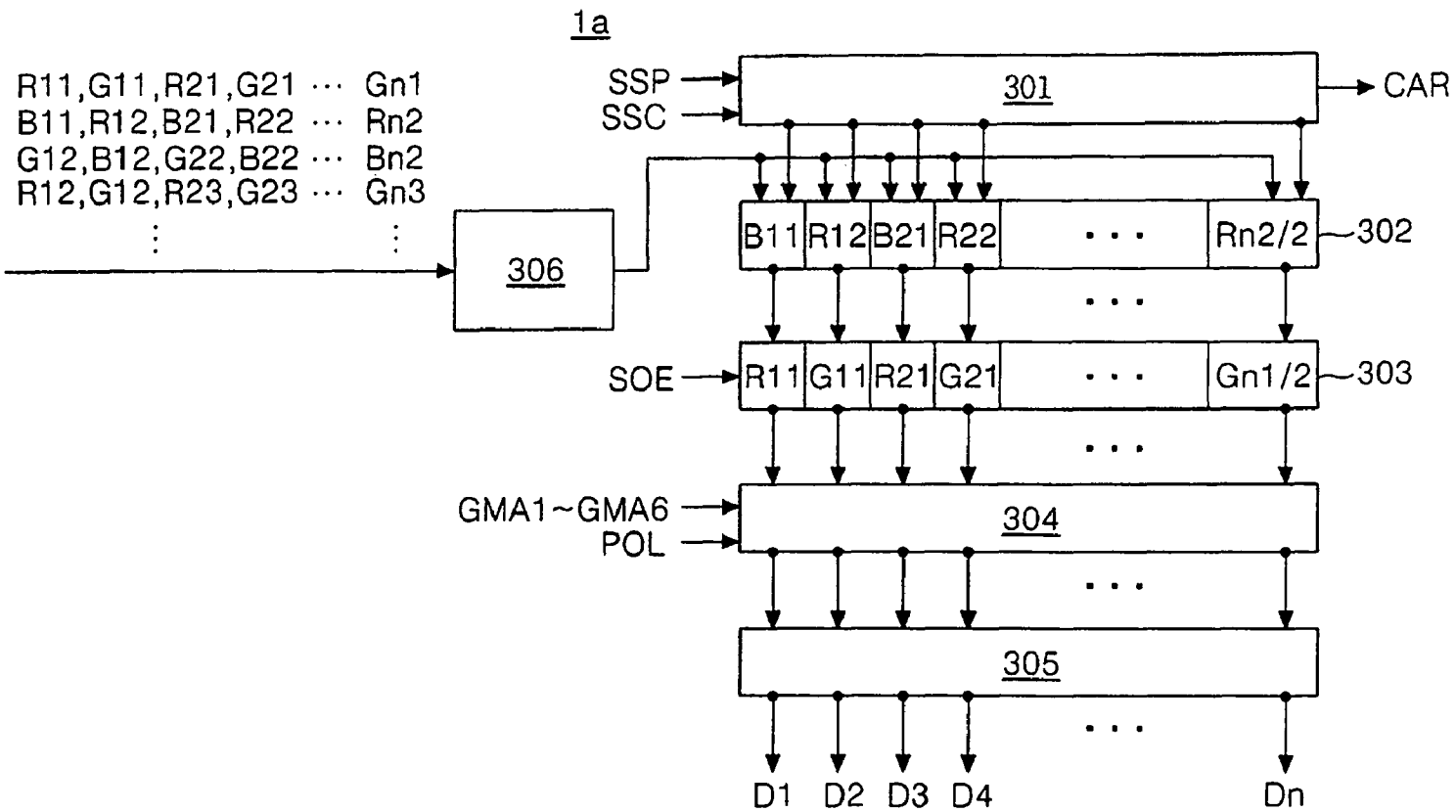
FIG. 23 is a diagram of illustrating a structure and an operation of source drive integrated circuit to generate a data voltage of FIG. 22.

FIG. 23 illustrates the structure and operation of source drive integrated circuits ICs 1*a* and 1*b* to generate the data voltage, which details the first source drive integrated circuit IC 1*a*. Referring to FIG. 23, the first source drive integrated circuit IC 1*a* includes a shift register 301, a first latch 302, a second latch 303, a DAC 304, an output buffer 305 and a register 306. The first source drive integrated circuit IC 1*a* supplies the digital video data input in order of R11, G11, R21, G21 . . . Gn1, B11, B12, B21, R22 . . . Rn2, G12, B12, G22, B22 . . . Bn2, R13, G13, R23, G23 . . . Gn3 from the timing controller 3 to the data lines D1 to Dn through the first and second latches 302 and 303.

Figure 24:
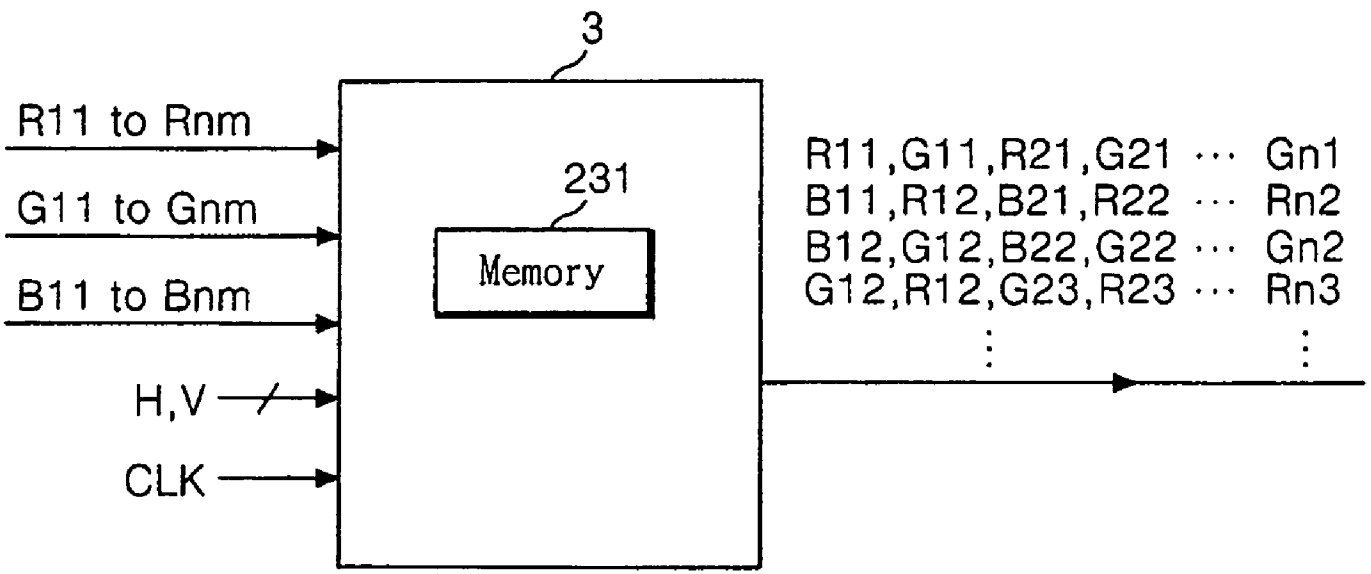
FIG. 24 is an exemplary diagram of illustrating a timing controller to align digital video data according to an arrangement of signal line and sub-pixel of FIGS. 20 and 21.

FIG. 24 illustrates one example of illustrating the timing controller 3 to align the digital video data according to the arrangement of signal lines and sub-pixels of FIGS. 20 and 21. Referring to FIG. 24, the timing controller 3 includes a memory 231. The memory 231 is supplied with red digital video data input in order of R11 to Rnm through a first data input line, green digital video data input in order of G11 to Gnm through a second data input line, and blue digital video data input in order of B11 to Bnm through a third data input line. The memory 231 re-aligns the data under the control of a memory controller (not shown), and outputs the re-aligned data in order of R11, G11, R21, G21 . . . Gn1, B11, R12, B21, R22 . . . Rn2, B12, G12, B22, G22 . . . Gn2, G13, R13, G23, R23 . . . Rn3 through the data output lines. Thus, the speed of outputting the data video data from the memory 231 is two times as rapid as the related art, so that the period of inputting data of timing controller 3 becomes short to ½.

Figure 25:
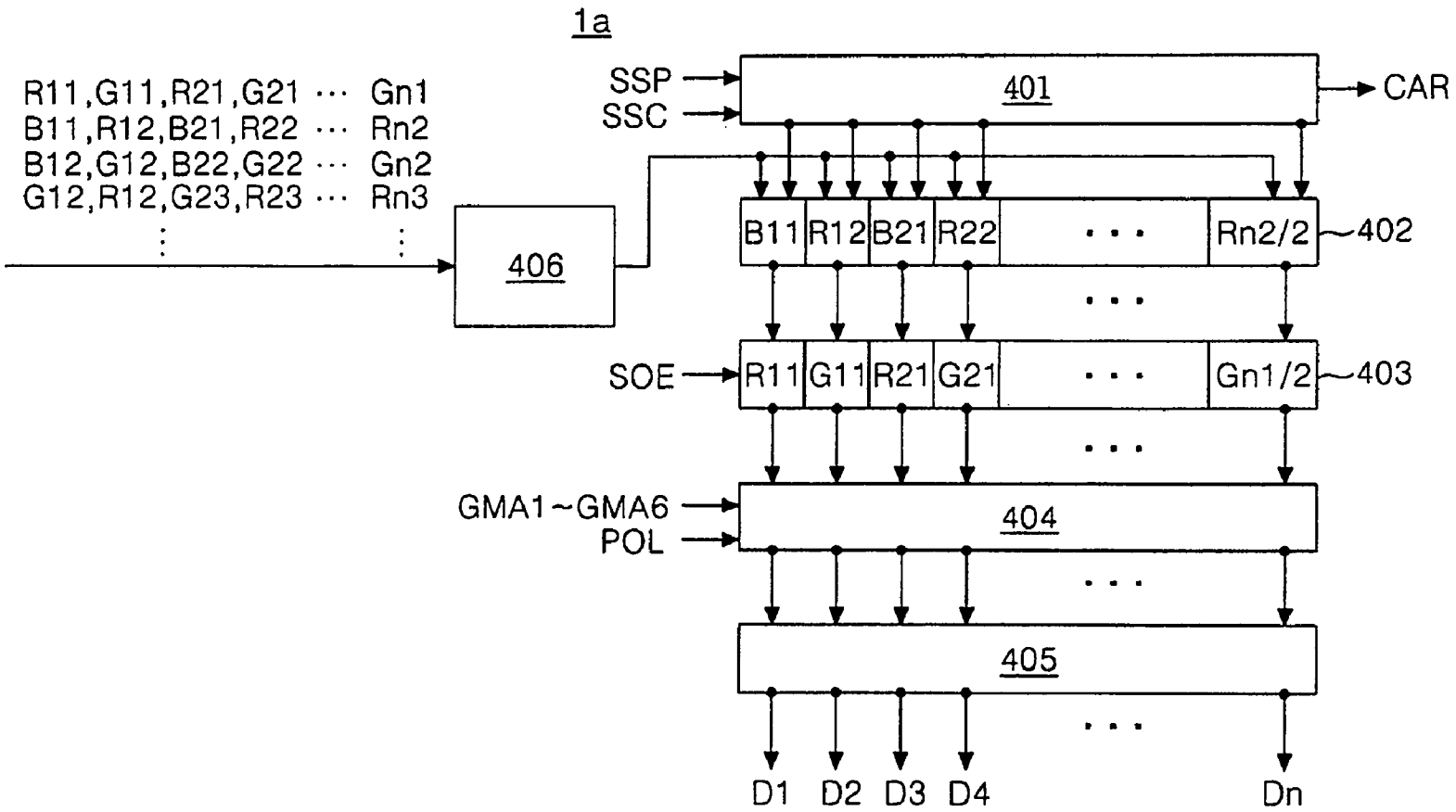
FIG. 25 is a diagram of illustrating a structure and an operation of source drive integrated circuit to generate a data voltage of FIG. 24.

FIG. 25 illustrates the structure and operation of source drive integrated circuits ICs 1*a* and 1*b* to generate the data voltage of FIG. 24, which details the first source drive integrated circuit IC 1*a*. Referring to FIG. 25, the first source drive integrated circuit IC 1*a* includes a shift register 401, a first latch 402, a second latch 403, a DAC 404, an output buffer 405 and a register 406. The first source drive integrated circuit IC 1*a* supplies the digital video data input in order of R11, G11, G21 . . . Gn1, B11, R12, B21, R22 . . . Rn2, B12, G12, B22, G22 . . . Gn2, G13, R13, G23, R23 . . . Rn3 form the timing controller 3 to the data lines D1 to Dn through the first and second latches 402 and 403.

As mentioned above, the liquid crystal display device according to the present disclosure and the method of driving the same have the following advantages.

In the liquid crystal display device according to the present disclosure, the data lines are formed along the short-axis direction of liquid crystal panel, so that it is possible to decrease the number of data lines used therein. Accordingly, the expensive source drive integrated circuits ICs used for driving the data lines can be decreased in number and the FPC and PCB can be simplified and small-sized.

In the driving method of liquid crystal display device according to the present disclosure, since the common voltage line is formed in parallel to the data line, it is possible to prevent the change of common voltage caused by the crossing of signal lines. In addition to the decreased number of data lines used, the two sub-pixels use one gate line in common, whereby the charging time of data voltage can be easily obtained with the decreased number of gate lines.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a liquid crystal panel including a plurality of odd and even numbered data lines arranged along a short-axis direction of substrate, and a plurality of gate lines arranged along a long-axis direction of substrate, wherein each gate line is orthogonal to each data line;

a data driving circuit to supply data voltages to the data lines;

a gate driving circuit to supply scan pulses to the gate lines; and a timing controller to supply digital video data to the data driving circuit, and to control the data driving circuit and the gate driving circuit, wherein two sub-pixels with one gate line interposed therebetween use one gate line in common;

wherein the liquid crystal panel comprises: a plurality of red sub-pixels arranged along the short-axis direction of substrate; a plurality of green sub-pixels arranged along the short-axis direction of substrate; and a plurality of blue sub-pixels arranged along the short-axis direction of substrate;

wherein the sub-pixels positioned at the left side of the gate line are supplied with the data voltage from the odd numbered data line, and the sub-pixels positioned at the right side of the gate line are supplied with the data voltage from the even numbered data line, on assumption that the plurality of red, green and blue sub-pixels are provided with the gate line interposed in-between;

wherein the gate driving circuit generates the scan pulse whose pulse width corresponds to ½ of one horizontal period;

wherein the data driving circuit firstly supplies the red and green data voltages corresponding to the red and green digital video data to the respective odd and even numbered data lines during about ½ horizontal period; secondly supplies the blue and red data voltages corresponding to the blue and red digital video data to the respective odd and even numbered data lines during about horizontal period; and thirdly supplies the green and blue data voltages corresponding to the green and blue digital video data to the respective odd and even numbered data lines during about ½ horizontal period.

2. The liquid crystal display device of claim 1, wherein the '4i+1'th and '4i+2'th sub-pixels ('i' is 0 or integer) positioned at the left side of the gate line are supplied with the data voltage from the odd numbered data line, and the '4i+3'th and '4i+4'th sub-pixels are supplied with the data voltage from the even numbered data line, on assumption that the plurality of red, green and blue sub-pixels are provided with the gate line interposed in-between.

3. The liquid crystal display device of claim 1, wherein the '4i+1'th and '4i+2'th sub-pixels ('i' is 0 or integer) positioned at the right side of the gate line are supplied with the data voltage from the even numbered data line, and the '4i+3'th and '4i+4'th sub-pixels are supplied with the data voltage from the odd numbered data line, on assumption that the plurality of red, green and blue sub-pixels are provided with the gate line interposed in-between.

4. The liquid crystal display device of claim 3, wherein the gate driving circuit generates the scan pulse whose pulse width corresponds to ½ horizontal period.

5. The liquid crystal display device of claim 4, wherein the data driving circuit firstly supplies the red and green data voltages corresponding to the red and green digital video data to the odd and even numbered data lines during ½ horizontal period; secondly supplies the blue and red data voltages corresponding to the blue and red digital video data to the odd and even numbered data lines during ½ horizontal period; and thirdly supplies the green and blue data voltages corresponding to the green and blue digital video data to the even and odd numbered data lines during ½ horizontal period.

6. The liquid crystal display device of claim 1, further comprising a common voltage supplying line to supply the same common voltage to common electrode of the sub-pixels, wherein the common electrode is parallel to the data line without crossing the data line.

7. The liquid crystal display device of claim 1, wherein the timing controller includes a memory which stores the red, green and blue digital video data, firstly supplies the red digital video data for one line to the data driving circuit, secondly supplies the green digital video data for one line to the data driving circuit, and thirdly supplies the blue digital video data for one line to the data driving circuit.

8. The liquid crystal display device of claim 1, wherein the timing controller includes a memory which stores the red, green and blue digital video data, firstly supplies the red and green digital video data for one line to the data driving circuit, secondly supplies the blue and red digital video data for one line to the data driving circuit, and thirdly supplies the green and blue digital video data for one line to the data driving circuit.

9. A liquid crystal display device comprising:

a liquid crystal panel including a plurality of data lines arranged along a short-axis direction of substrate, and a plurality of gate lines arranged along a long-axis direction of substrate, wherein each gate line is orthogonal to each data line;

a data driving circuit to supply data voltages to the data lines;

a gate driving circuit to supply scan pulses to the gate lines; and a timing controller to supply digital video data to the data driving circuit, and to control the data driving circuit and the gate driving circuit;

wherein the liquid crystal panel comprises: a plurality of red sub-pixels arranged along the short-axis direction of substrate; a plurality of green sub-pixels arranged along the short-axis direction of substrate; and a plurality of blue sub-pixels arranged along the short-axis direction of substrate;

wherein the gate driving circuit generates the scan pulse whose pulse width is smaller than one horizontal period, wherein the data driving circuit supplies red data voltages corresponding to the red digital video data to the data lines during about ⅓ horizontal period, supplies green data voltages corresponding to the green digital video data to the data lines during about ⅓ horizontal period, and supplies blue data voltage corresponding to the blue digital video data to the data lines during about ⅓ horizontal period.

10. A liquid crystal display device comprising:

a liquid crystal panel including a plurality of data lines arranged along a short-axis direction of substrate, and a plurality of gate lines arranged along a long-axis direction of substrate, wherein each gate line is orthogonal to each data line;

a data driving circuit to supply data voltages to the data lines;

a gate driving circuit to supply scan pulses to the gate lines;

a timing controller to supply digital video data to the data driving circuit, and to control the data driving circuit and the gate driving circuit;

a plurality of red sub-pixels arranged along the long-axis direction of substrate;

a plurality of green sub-pixels arranged along the long-axis direction of substrate; and a plurality of blue sub-pixels arranged along the long-axis direction of substrate.

11. The liquid crystal display device of claim 10, wherein the gate driving circuit generates the scan pulse whose pulse width corresponds to one horizontal period.

12. The liquid crystal display device of claim 11, wherein the data driving circuit supplies red, green and blue data voltages to the respective data lines during one horizontal period.

* * * * *